US006948316B2

(12) United States Patent
Minemi et al.

(10) Patent No.: US 6,948,316 B2
(45) Date of Patent: Sep. 27, 2005

(54) RANKINE CYCLE SYSTEM

(75) Inventors: Masahiko Minemi, Wako (JP); Hiroyoshi Taniguchi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/483,087

(22) PCT Filed: Jul. 10, 2002

(86) PCT No.: PCT/JP02/07019

§ 371 (c)(1),
(2), (4) Date: Aug. 4, 2004

(87) PCT Pub. No.: WO03/006802

PCT Pub. Date: Jan. 23, 2003

(65) Prior Publication Data

US 2004/0250544 A1 Dec. 16, 2004

(30) Foreign Application Priority Data

Jul. 10, 2001 (JP) ..... 2001-209052
Jul. 10, 2001 (JP) ..... 2001-209053
Jun. 17, 2002 (JP) ..... 2002-175403

(51) Int. Cl.[7] ..... F01K 25/00
(52) U.S. Cl. ..... 60/671; 60/670
(58) Field of Search ..... 60/670, 671, 673; 70/670, 671, 673

(56) References Cited

U.S. PATENT DOCUMENTS 3,584,457 A 6/1971 Davoud
3,603,087 A * 9/1971 Burkland ..... 60/657
3,740,057 A * 6/1973 Doyle et al. ..... 277/366
4,241,591 A 12/1980 Edwards
4,738,111 A * 4/1988 Edwards ..... 60/671
4,829,786 A 5/1989 Sand et al.

FOREIGN PATENT DOCUMENTS

| | | | |
|---|---|---|---|
| CH | 146 359 | A | 4/1931 |
| GB | 211844 | A | 4/1925 |
| GB | 370194 | A | 4/1932 |
| JP | 72402/1983 | A | 2/1983 |
| JP | 17202/1984 | A | 2/1984 |
| JP | 63-156508 | A | 6/1988 |
| WO | WO-98/14257 | A1 | 4/1998 |

* cited by examiner

*Primary Examiner*—Hoang Nguyen
(74) *Attorney, Agent, or Firm*—Birch, Stewart, Kolasch & Birch, LLP

(57) ABSTRACT

A Rankine cycle system having a working medium circulation circuit (110) that includes an evaporator (112), an expander (113), a condenser (114), and a feed pump (115) is provided in which a mixture of oil for lubricating the expander (113) and water, which is a working medium and has become mixed with the oil, is supplied to coalescer type water separating means (118), thus separating the water from the oil. The oil from which water has been separated in water separating means (118) is returned to the expander (113), and the water separated from the oil is returned to the working medium circulation circuit (110). It is thus unnecessary to replenish the working medium circulation circuit (110) with water or replenish the expander (113) with oil.

20 Claims, 25 Drawing Sheets

RANKINE CYCLE SYSTEM

FIELD OF THE INVENTION

The present invention relates to a Rankine cycle system having an evaporator, an expander, a condenser, and a feed pump provided along a working medium circulation circuit and, in particular, to a Rankine cycle system provided with means for separating a working medium that has become mixed with a lubricating medium of the expander, or to a Rankine cycle system provided with means for separating the lubricating medium of the expander that has become mixed with the working medium.

BACKGROUND ART

When a lubricating medium of an expander has become mixed with a working medium circulating around a closed circuit of a Rankine cycle system, the amount of lubricating medium in the expander becomes insufficient, thus degrading the efficiency of the expander or causing seizing. Japanese Utility Model Publication No. 61-8170 discloses a gas/liquid separator for separating a lubricating medium from a working medium and returning it to an expander.

There is also known from Japanese Patent Application Laid-open No. 63-156508 a so-called coalescer type oil/water separating filter in which, by supplying a mixture of oil and water to an ultrafine fiber filter, oil droplets attached to the fiber become coarser and thus separate from the water by virtue of the difference in specific gravity between the oil and water, or water droplets attached to the fiber become coarser and thus separate from the oil by virtue of the difference in specific gravity between water and the oil.

However, in the Rankine cycle system disclosed in Japanese Utility Model Publication No. 61-8170, since the mixture of the working medium and the lubricating medium circulates in the closed circuit, there is a possibility that the lubricating medium in the working medium circulating in the closed circuit might gasify due to heat, thus affecting the performance and the durability of the Rankine cycle system. Furthermore, since a mixture of liquid-phase working medium, gas-phase working medium, and lubricating medium is supplied from a boiler to the gas/liquid separator and, moreover, the gas/liquid separator has a structure in which the lubricating medium is separated by gravity, there is the problem that it is impossible to prevent the liquid-phase working medium from becoming mixed with the lubricating medium.

DISCLOSURE OF THE INVENTION

The present invention has been achieved under the above-mentioned circumstances, and it is an object thereof to provide a Rankine cycle system equipped with an expander that is lubricated by a lubricating medium, the lubricating medium of the expander being regenerated by reliably separating a working medium that has become mixed with the lubricating medium, or the working medium being regenerated by reliably separating the lubricating medium that has become mixed with the working medium in the expander.

In order to achieve this object, in accordance with a first aspect of the present invention, there is proposed a Rankine cycle system that includes a working medium circulation circuit that includes an evaporator that generates a high-temperature, high-pressure gas-phase working medium by heating a liquid-phase working medium by means of waste heat of a heat engine, an expander that converts the heat and pressure of the gas-phase working medium supplied from the evaporator into mechanical energy, a condenser that cools the gas-phase working medium whose temperature and pressure have decreased in the expander to turn the working medium back into the liquid-phase working medium, and a feed pump that supplies the liquid-phase working medium discharged from the condenser to the evaporator, characterized in that the expander has a sliding section thereof lubricated by a lubricating medium that is different from the working medium, the Rankine cycle system further includes working medium separating means for separating from the lubricating medium the working medium that has become mixed with the lubricating medium in the expander, and the working medium separating means is provided at a position where the working medium is in a liquid-phase state.

In accordance with this arrangement, when separating the working medium contained in the lubricating medium of the expander of the Rankine cycle system, the lubricating medium is separated when the working medium is in the liquid-phase state, and it is therefore possible to separate the lubricating medium from the working medium more completely than can be done in a case in which the liquid-phase working medium and the gas-phase working medium are mixed.

Furthermore, in accordance with a second aspect of the present invention, in addition to the first aspect, there is proposed a Rankine cycle system wherein the working medium separating means exhibits a function of separating the working medium in a predetermined temperature range, and the working medium separating means is provided at a position where the lubricating medium is in the predetermined temperature range.

In accordance with this arrangement, since the working medium separating means that exhibits the function of separating the working medium in the predetermined temperature range is provided at a position where the temperature of the lubricating medium is in the predetermined temperature range, the function of separating the working medium can be exhibited stably while preventing any damage to the working medium separating means.

Moreover, in accordance with a third aspect of the present invention, in addition to the first or second aspect, there is proposed a Rankine cycle system wherein the working medium separating means is formed by connecting at least two working medium separating devices in line.

In accordance with this arrangement, since the working medium separating means is formed by connecting in line at least two working medium separating devices, it is possible to vary the separation characteristics of each of the working medium separating devices, and the separation performance can be improved and the dimensions of the working medium separating means can be reduced compared with a case in which the working medium separating means is formed from one working medium separating device.

Furthermore, in accordance with a fourth aspect of the present invention, there is proposed a Rankine cycle system that includes a working medium circulation circuit that includes an evaporator that generates a high-temperature, high-pressure gas-phase working medium by heating a liquid-phase working medium by means of waste heat of a heat engine, an expander that converts the heat and pressure of the gas-phase working medium supplied from the evaporator into mechanical energy, a condenser that cools the gas-phase working medium whose temperature and pressure have decreased in the expander to turn the working medium back into the liquid-phase working medium, and a feed pump that supplies the liquid-phase working medium discharged from the condenser to the evaporator, characterized in that the expander has a sliding section thereof lubricated by a lubricating medium that is different from the working medium, the Rankine cycle system further includes lubricating medium separating means for separating from the working medium the lubricating medium that has become mixed with the working medium in the expander, and the lubricating medium separating means is provided at a position on the downstream side of the expander where the working medium is in a liquid-phase state.

In accordance with this arrangement, when separating the lubricating medium contained in the working medium of the Rankine cycle system, the lubricating medium is separated when the working medium is in a liquid-phase state, and it is therefore possible to separate the lubricating medium from the working medium more completely than can be done in a case in which both the liquid-phase working medium and the gas-phase working medium are mixed.

Moreover, in accordance with a fifth aspect of the present invention, in addition to the fourth aspect, there is proposed a Rankine cycle system wherein the lubricating medium separating means exhibits a function of separating the lubricating medium in a predetermined temperature range, and the lubricating medium separating means is provided at a position where the liquid-phase working medium is in the predetermined temperature range.

In accordance with this arrangement, since the lubricating medium separating means that exhibits the function of separating the lubricating medium in the predetermined temperature range is provided at a position where the temperature of the liquid-phase working medium is in the predetermined temperature range, the function of separating the lubricating medium can be exhibited stably while preventing any damage to the lubricating medium separating means.

Furthermore, in accordance with a sixth aspect of the present invention, in addition to the fourth or fifth aspect, there is proposed a Rankine cycle system that further includes a gas/liquid separator for separating a liquid phase portion contained in the working medium discharged from the expander into the working medium circulation circuit, the liquid-phase working medium separated by the gas/liquid separator being supplied to the lubricating medium separating means.

In accordance with this arrangement, since the liquid phase portion contained in the working medium discharged from the expander into the working medium circulation circuit is separated by the gas/liquid separator and supplied to the lubricating medium separating means, the working medium that is to be supplied to the lubricating medium separating means is reliably converted into the liquid phase, thereby improving the function of separating the lubricating medium.

Moreover, in accordance with a seventh aspect of the present invention, in addition to the first, second, fourth, or fifth aspect, there is proposed a Rankine cycle system that further includes working medium purifying means for removing cations or dissolved gas contained in the working medium that has been discharged from the expander into the working medium circulation circuit and that has been turned back into the liquid phase state.

In accordance with this arrangement, since the working medium purifying means removes cations and dissolved gas contained in the working medium that has been discharged from the expander into the working medium circulation circuit and that has been turned back into the liquid-phase state, contamination and corrosion of each section of the working medium circulation circuit, through which the working medium circulates, can be prevented more reliably.

Furthermore, in accordance with an eighth aspect of the present invention, in addition to the first, second, fourth, or fifth aspect, there is proposed a Rankine cycle system wherein the lubricating medium from which the working medium has been separated by the working medium separating means is returned to the expander.

In accordance with this arrangement, since the lubricating medium from which the working medium has been separated by the working medium separating means is returned to the expander, it is possible to prevent the working medium from becoming mixed with the lubricating medium and degrading the lubrication performance and, moreover, it is unnecessary to replenish the expander with the lubricating medium.

Moreover, in accordance with a ninth aspect of the present invention, in addition to the first, second, fourth, or fifth aspect, there is proposed a Rankine cycle system wherein the working medium separated from the lubricating medium by the working medium separating means is returned to the working medium circulation circuit.

In accordance with this arrangement, since the working medium from which the lubricating medium has been separated by the working medium separating means is returned to the working medium circulation circuit, it is possible to prevent any damage to the working medium circulation circuit due to the lubricating medium becoming mixed with the working medium and, moreover, it is unnecessary to replenish the working medium circulation circuit with the working medium.

Furthermore, in accordance with a tenth aspect of the present invention, in addition to the first, second, fourth, or fifth aspect, there is proposed a Rankine cycle system wherein the working medium separating means makes droplets of the working medium contained in the lubricating medium become coarse, and the working medium is separated by virtue of a difference in specific gravity between the lubricating medium and the working medium that has been made into coarse droplets.

In accordance with this arrangement, since the working medium separating means makes the droplets of the working medium become coarse and separates them from the lubricating medium by virtue of the difference in specific gravity, the working medium can be separated effectively from the lubricating medium with small pressure loss.

Moreover, in accordance with an eleventh aspect of the present invention, in addition to the first, second, fourth, or fifth aspect, there is proposed a Rankine cycle system wherein the working medium separating means is of a coalescer type.

In accordance with this arrangement, since the working medium separating means is of the coalescer type, the working medium can be separated effectively from the lubricating medium with small pressure loss.

Furthermore, in accordance with a twelfth aspect of the present invention, in addition to the eleventh aspect, there is proposed a Rankine cycle system wherein the working medium separating means includes a filter element formed from hydrophobic fiber.

In accordance with this arrangement, since the filter element of the working medium separating means is made of the hydrophobic fiber, the ability to separate the working medium from the lubricating medium can be improved.

Moreover, in accordance with a thirteenth aspect of the present invention, there is proposed a Rankine cycle system that includes a working medium circulation circuit that includes an evaporator that generates a high-temperature, high-pressure gas-phase working medium by heating a liquid-phase working medium by means of waste heat of a heat engine, an expander that converts the heat and pressure of the gas-phase working medium supplied from the evaporator into mechanical energy, a condenser that cools the gas-phase working medium whose temperature and pressure have decreased in the expander to turn the working medium back into the liquid-phase working medium, and a feed pump that supplies the liquid-phase working medium discharged from the condenser to the evaporator, characterized in that the expander has a sliding section thereof lubricated by a lubricating medium that is different from the working medium, the Rankine cycle system further includes working medium separating means for separating from the lubricating medium the working medium that has become mixed with the lubricating medium in the expander, and the lubricating medium is a hydrophobic oil containing no extreme pressure additive having surface activity.

In accordance with this arrangement, when separating the working medium contained in the lubricating medium of the expander by the working medium separating means, since the lubricating medium is a hydrophobic oil containing no extreme pressure additive having surface activity, it is possible to prevent any degradation in the lubrication performance due to emulsification of the lubricating medium and, moreover, the ability to separate the working medium and the lubricating medium can be improved.

Water and steam of an embodiment correspond to the working medium of the present invention, an oil of the embodiment corresponds to the lubricating medium of the present invention, an internal combustion engine 111 of the embodiment corresponds to the heat engine of the present invention, water separating means 118 of the embodiment corresponds to the working medium separating means of the present invention, an upstream side water separating device 121 and a downstream side water separating device 122 of the embodiment correspond to the working medium separating device of the present invention, water purifying means 132 of the embodiment corresponds to the working medium purifying means of the present invention, and oil separating means 137 of the embodiment corresponds to the lubricating medium separating means of the present invention.

BRIEF DESCRIPTION OF THE DRAWINGS

FIG. 1 to FIG. 25 illustrate one embodiment of the present invention; FIG. 1 is a vertical sectional view of an expander;

FIG. 2 is a sectional view along line 2—2 in FIG. 1;

FIG. 3 is an enlarged view of part 3 in FIG. 1;

FIG. 4 is an enlarged sectional view of part 4 in FIG. 1 (sectional view along line 4—4 in FIG. 8);

FIG. 5 is a view from arrowed line 5—5 in FIG. 4;

FIG. 6 is a view from arrowed line 6—6 in FIG. 4;

FIG. 7 is a sectional view along line 7—7 in FIG. 4;

FIG. 8 is a sectional view along line 8—8 in FIG. 4;

FIG. 9 is a sectional view along line 9—9 in FIG. 4;

FIG. 10 is a view from arrowed line 10—10 in FIG. 1;

FIG. 11 is a view from arrowed line 11—11 in FIG. 1;

FIG. 12 is a sectional view along line 12—12 in FIG. 10;

FIG. 13 is a sectional view along line 13—13 in FIG. 11;

FIG. 14 is a sectional view along line 14—14 in FIG. 10;

FIG. 15 is a graph showing torque variations of an output shaft;

FIG. 16 is an explanatory diagram showing the operation of an intake system of a high-pressure stage;

FIG. 17 is an explanatory diagram showing the operation of a discharge system of the high-pressure stage and an intake system of a low-pressure stage; and FIG. 18 is an explanatory diagram showing the operation of a discharge system of the low-pressure stage;

FIG. 19 is a diagram showing the overall arrangement of the Rankine cycle system;

FIG. 20 is a diagram showing the structure of water separating means;

FIG. 21 is a sectional view along line 21—21 in FIG. 20;

FIG. 22 is a sectional view along line 22—22 in FIG. 20;

FIG. 25 is a diagram showing the structure of oil separating means.

BEST MODE FOR CARRYING OUT THE INVENTION

An embodiment of the present invention is explained below with reference to the attached drawings.

Firstly, an outline of the structure of an expander 113 of a Rankine cycle system is explained with reference to FIG. 1 to FIG. 3.

Figure 12:
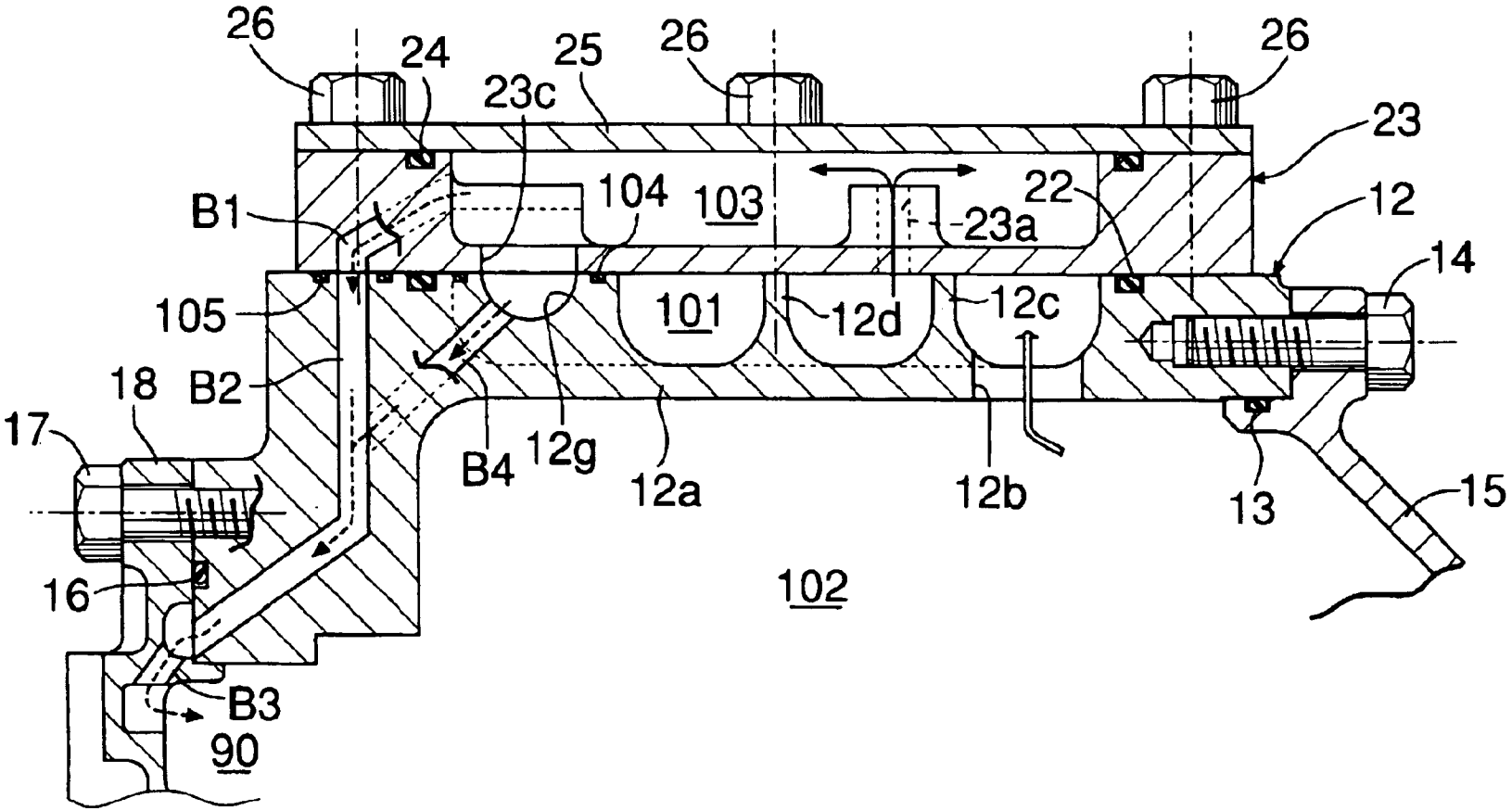
Figure 13:
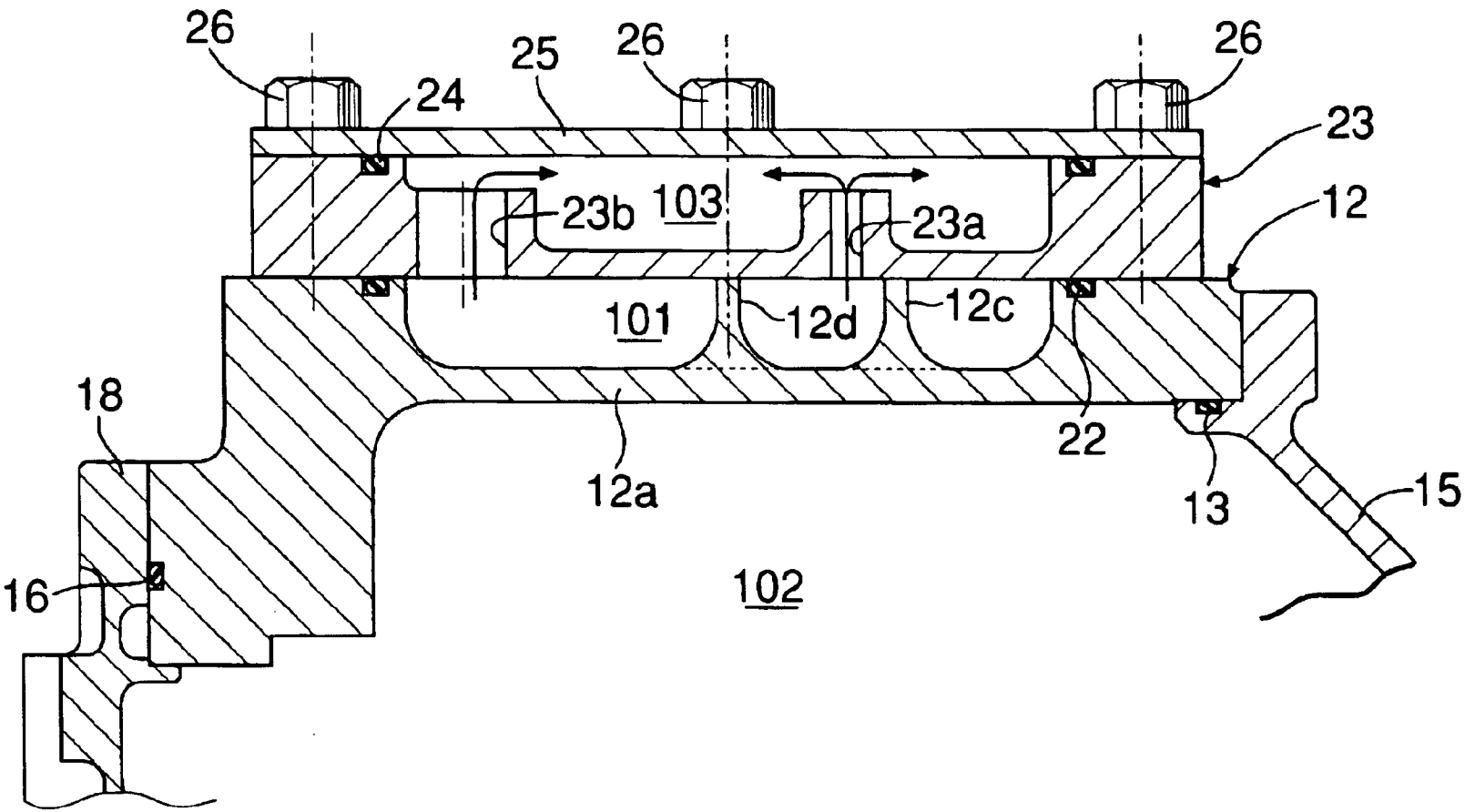
Figure 14:
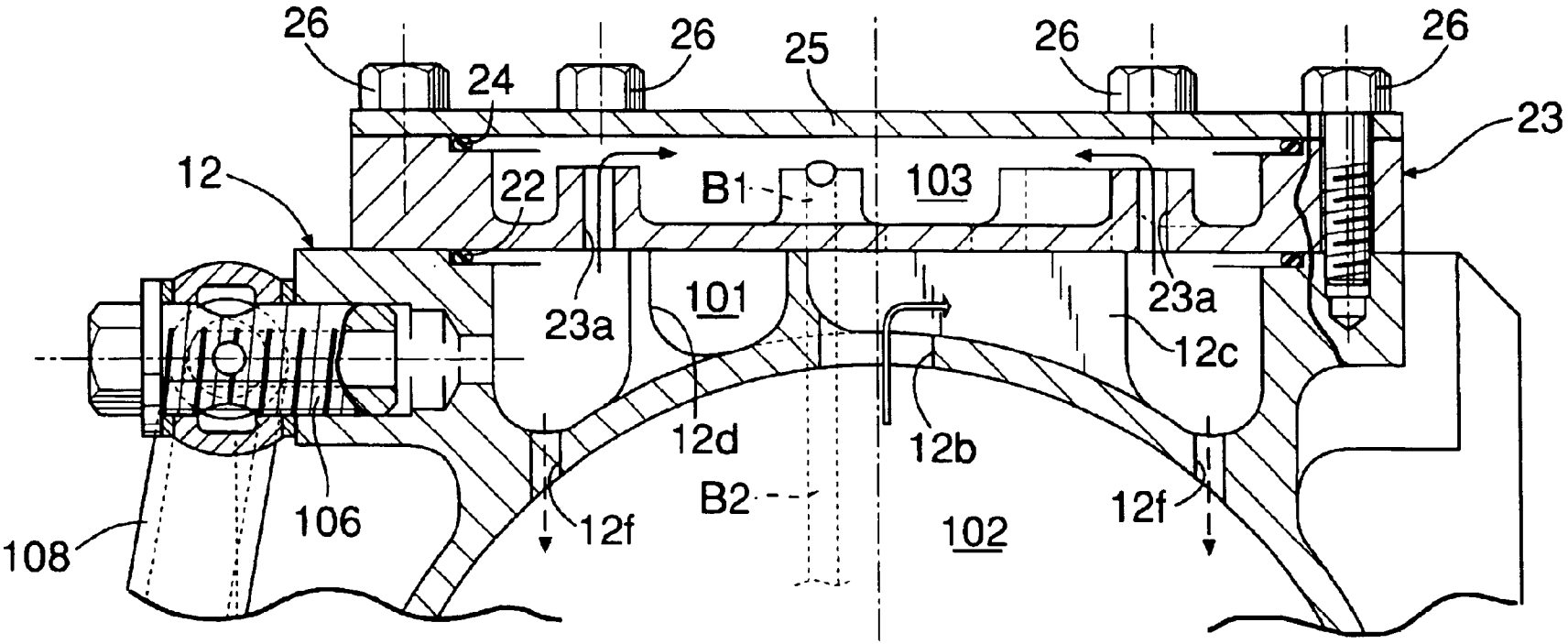

The expander 113 converts the thermal energy and the pressure energy of high-temperature, high-pressure steam as a working medium into mechanical energy and outputs it. A casing 11 of the expander 113 is formed from a casing main body 12, a front cover 15 fitted via a seal 13 into a front opening of the casing main body 12 and joined thereto via a plurality of bolts 14, and a rear cover 18 fitted via a seal 16 onto a rear opening of the casing main body 12 and joined thereto via a plurality of bolts 17. An oil pan 19 abuts against a lower opening of the casing main body 12 via a seal 20 and is joined thereto via a plurality of bolts 21. Furthermore, a breather chamber dividing wall 23 is superimposed on an upper surface of the casing main body 12 via a seal 22 (see FIG. 12), a breather chamber cover 25 is further superimposed on an upper surface of the breather chamber dividing wall 23 via a seal 24 (see FIG. 12), and they are together secured to the casing main body 12 by means of a plurality of bolts 26.

A rotor 27 and an output shaft 28 that can rotate around an axis L extending in the fore-and-aft direction in the center of the casing 11 are united by welding. A rear part of the rotor 27 is rotatably supported in the casing main body 12 via an angular ball bearing 29 and a seal 30, and a front part of the output shaft 28 is rotatably supported in the front cover 15 via an angular ball bearing 31 and a seal 32. A swash plate holder 36 is fitted via two seals 33 and 34 and a knock pin 35 in a rear face of the front cover 15 and fixed thereto via a plurality of bolts 37, and a swash plate 39 is rotatably supported in the swash plate holder 36 via an angular ball bearing 38. The rotational axis of the swash plate 39 is inclined relative to the axis L of the rotor 27 and the output shaft 28, and the angle of inclination is fixed.

Seven sleeves 41 formed from members that are separate from the rotor 27 are arranged within the rotor 27 so as to surround the axis L at equal intervals in the circumferential direction. High-pressure pistons 43 are slidably fitted in high-pressure cylinders 42 formed at inner peripheries of the sleeves 41, which are supported by sleeve support bores 27*a* of the rotor 27. Hemispherical parts of the high-pressure pistons 43 projecting forward from forward end openings of the high-pressure cylinders 42 abut against seven dimples 39*a* recessed in a rear surface of the swash plate 39. Heat resistant metal seals 44 are fitted between the rear ends of the sleeves 41 and the sleeve support bores 27*a* of the rotor 27, and a single set plate 45 retaining the front ends of the sleeves 41 in this state is fixed to a front surface of the rotor 27 by means of a plurality of bolts 46. The sleeve support bores 27*a* have a slightly larger diameter in the vicinity of their bases, thus forming a gap $\alpha$ (see FIG. 3) between themselves and the outer peripheries of the sleeves 41.

The high-pressure pistons 43 include pressure rings 47 and oil rings 48 for sealing the surfaces that slide against the high-pressure cylinders 42, and the sliding range of the pressure rings 47 and the sliding range of the oil rings 48 are set so as not to overlap each other. Tapered openings 45*a* widening toward the front are formed in the set plate 45 in order to make the pressure rings 47 and the oil rings 48 engage smoothly with the high-pressure cylinders 42 when the high-pressure pistons 43 are inserted into the high-pressure cylinders 42.

As hereinbefore described, since the sliding range of the pressure rings 47 and the sliding range of the oil rings 48 are set so as not to overlap each other, a lubricating medium oil attached to the inner walls of the high-pressure cylinders 42 against which the oil rings 48 slide will not be taken into high-pressure operating chambers 82 due to sliding of the pressure rings 47, thereby reliably preventing the oil from contaminating the steam. In particular, the high-pressure pistons 43 have a slightly smaller diameter part between the pressure rings 47 and the oil rings 48 (see FIG. 3), thereby effectively preventing the oil attached to the sliding surfaces of the oil rings 48 from moving to the sliding surfaces of the pressure rings 47.

Since the high-pressure cylinders 42 are formed by fitting the seven sleeves 41 in the sleeve support bores 27*a* of the rotor 27, a material having excellent thermal conductivity, heat resistance, abrasion resistance, strength, etc. can be selected for the sleeves 41. This not only improves the performance and the reliability, but also machining becomes easy compared with a case in which the high-pressure cylinders 42 are directly machined in the rotor 27, and the machining precision also increases. When any one of the sleeves 41 is worn or damaged, it is possible to replace only the faulty sleeve 41, without replacing the entire rotor 27, and this is economical.

Furthermore, since the gap $\alpha$ is formed between the outer periphery of the sleeves 41 and the rotor 27 by slightly enlarging the diameter of the sleeve support bores 27*a* in the vicinity of the base, even when the rotor 27 is thermally deformed by the high-temperature, high-pressure steam supplied to the high-pressure operating chambers 82, this is prevented from affecting the sleeves 41, thereby preventing the high-pressure cylinders 42 from distorting.

The seven high-pressure cylinders 42 and the seven high-pressure pistons 43 fitted therein form a first axial piston cylinder group 49.

Seven low-pressure cylinders 50 are arranged at circumferentially equal intervals on the outer peripheral part of the rotor 27 so as to surround the axis L and the radially outer side of the high-pressure cylinders 42. These low-pressure cylinders 50 have a larger diameter than that of the high-pressure cylinders 42, and the pitch at which the low-pressure cylinders 50 are arranged in the circumferential direction is displaced by half a pitch relative to the pitch at which the high-pressure cylinders 42 are arranged in the circumferential direction. This makes it possible for the high-pressure cylinders 42 to be arranged in spaces formed between adjacent low-pressure cylinders 50, thus utilizing the spaces effectively and contributing to a reduction in the diameter of the rotor 27.

The seven low-pressure cylinders 50 have low-pressure pistons 51 slidably fitted thereinto, and these low-pressure pistons 51 are connected to the swash plate 39 via links 52. That is, spherical parts 52*a* at the front end of the links 52 are swingably supported in spherical bearings 54 fixed to the swash plate 39 via nuts 53, and spherical parts 52*b* at the rear end of the links 52 are swingably supported in spherical bearings 56 fixed to the low-pressure pistons 51 by clips 55. A pressure ring 78 and an oil ring 79 are fitted around the outer periphery of each of the low-pressure pistons 51 in the vicinity of the top surface thereof so as to adjoin each other. Since the sliding ranges of the pressure ring 78 and the oil ring 79 overlap each other, an oil film is formed on the sliding surface of the pressure ring 78, thus enhancing the sealing characteristics and the lubrication.

The seven low-pressure cylinders 50 and the seven low-pressure pistons 41 fitted therein form a second axial piston cylinder group 57.

An oil used in a reciprocating engine, etc. contains a surfactant and an extreme pressure agent. Representative examples of the extreme pressure agent include molybdenum compounds represented by molybdenum sulfides (e.g., molybdenum disulfide, etc.). When the oil (hydrophilic oil) to which an extreme pressure agent has been added is strongly agitated, water is surrounded by the extreme pressure agent and the surfactant, which have hydrophilic groups, and not only is the function as a lubricating oil degraded, but also it becomes difficult to carry out separation of water since the emulsified mixture is stabilized. Because of this, in this embodiment a hydrophobic oil containing no hydrophilic additive is used as the lubricating medium of the expander 113.

As hereinbefore described, since the front ends of the high-pressure pistons 43 of the first axial piston cylinder group 49 are made in the form of hemispheres and are made to abut against the dimples 39*a* formed in the swash plate 39, it is unnecessary to connect the high-pressure pistons 43 to the swash plate 39 mechanically, thus reducing the number of parts and improving the ease of assembly. On the other hand, the low-pressure pistons 51 of the second axial piston cylinder group 57 are connected to the swash plate 39 via the links 52 and their front and rear spherical bearings 54 and 56, and even when the temperature and the pressure of medium-temperature, medium-pressure steam supplied to the second axial piston cylinder group 57 become insufficient and the pressure of low-pressure operating chambers 84 becomes negative, there is no possibility of the low-pressure pistons 51 becoming detached from the swash plate 39 and causing knocking or damage.

Furthermore, when the swash plate 39 is secured to the front cover 15 via the bolts 37, changing the phase at which the swash plate 39 is secured around the axis L enables the timing of supply and discharge of the steam to and from the first axial piston cylinder group 49 and the second axial piston cylinder group 57 to be shifted, thereby altering the output characteristics of the expander 113.

Moreover, since the rotor 27 and the output shaft 28, which are united, are supported respectively by the angular ball bearing 29 provided on the casing main body 12 and the angular ball bearing 31 provided on the front cover 15, by adjusting the thickness of a shim 58 disposed between the casing main body 12 and the angular ball bearing 29 and the thickness of a shim 59 disposed between the front cover 15 and the angular ball bearing 31, the longitudinal position of the rotor 27 along the axis L can be adjusted. By adjusting the position of the rotor 27 in the axis L direction, the relative positional relationship in the axis L direction between the high-pressure and low-pressure pistons 43 and 51 guided by the swash plate 39, and the high-pressure and low-pressure cylinders 42 and 50 provided in the rotor 27 can be changed, thereby adjusting the expansion ratio of the steam in the high-pressure and low-pressure operating chambers 82 and 84.

If the swash plate holder 36 supporting the swash plate 39 were formed integrally with the front cover 15, it would be difficult to secure a space for attaching and detaching the angular ball bearing 31 or the shim 59 to and from the front cover 15, but since the swash plate holder 36 is made detachable from the front cover 15, the above-mentioned problem can be eliminated. Moreover, if the swash plate holder 36 were integral with the front cover 15, during assembly and disassembly of the expander 113 it would be necessary to carry out cumbersome operations of connecting and disconnecting the seven links 52, which are in a confined space within the casing 11, to and from the swash plate 39 pre-assembled to the front cover 15, but since the swash plate holder 36 is made detachable from the front cover 15, it becomes possible to form a sub-assembly by assembling the swash plate 39 and the swash plate holder 36 to the rotor 27 in advance, thereby greatly improving the ease of assembly.

Systems for supply and discharge of steam to and from the first axial piston cylinder group 49 and the second axial piston cylinder group 57 are now explained with reference to FIG. 4 to FIG. 9.

Figure 4:
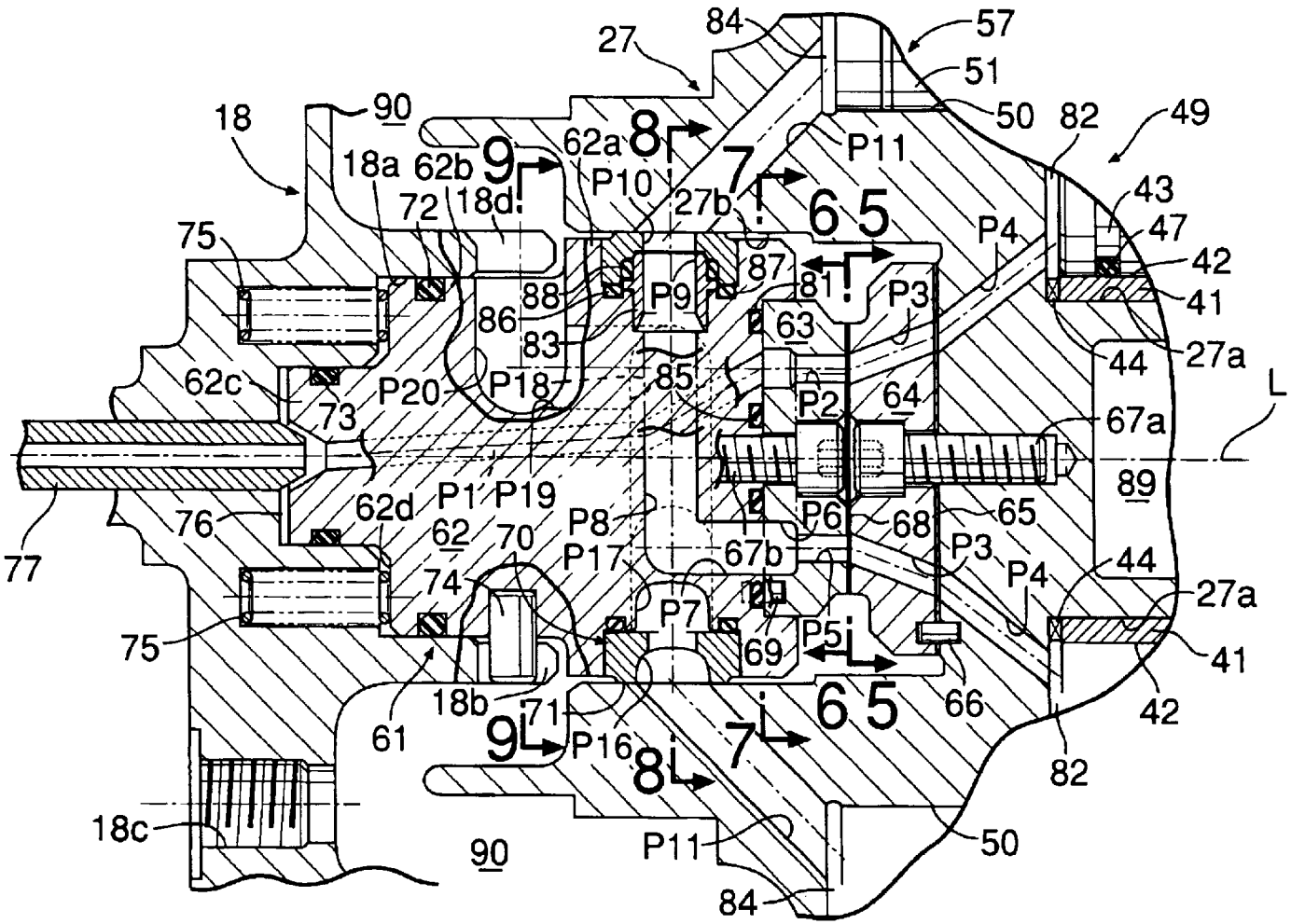
Figure 5:
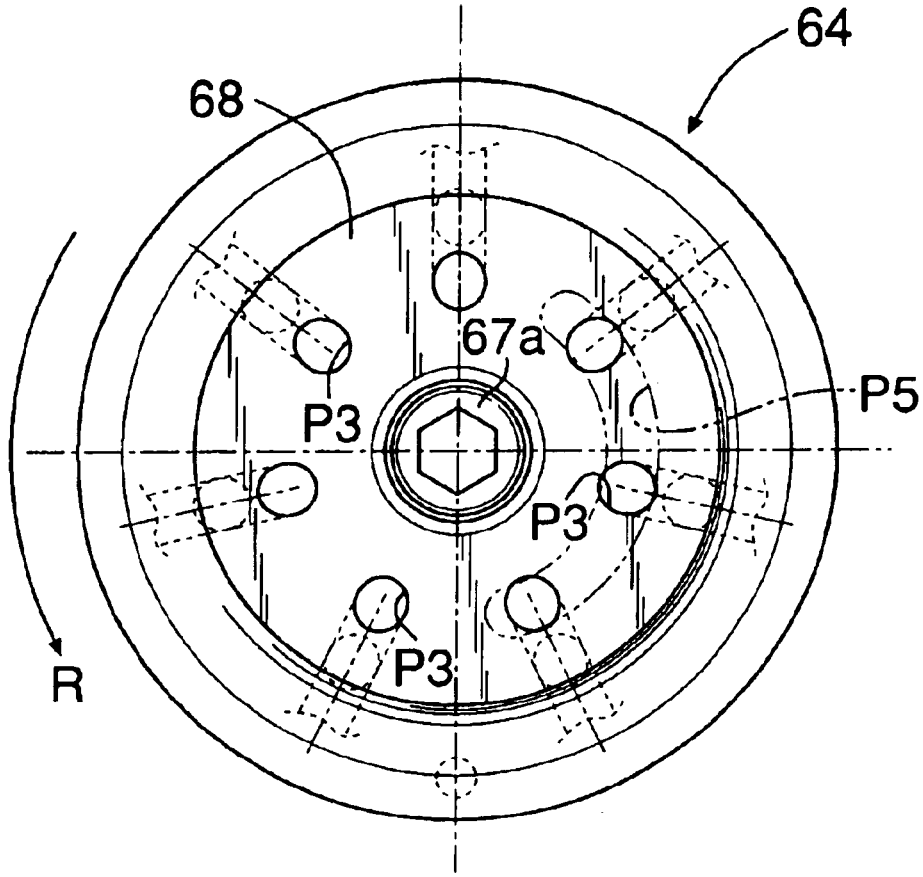
Figure 6:
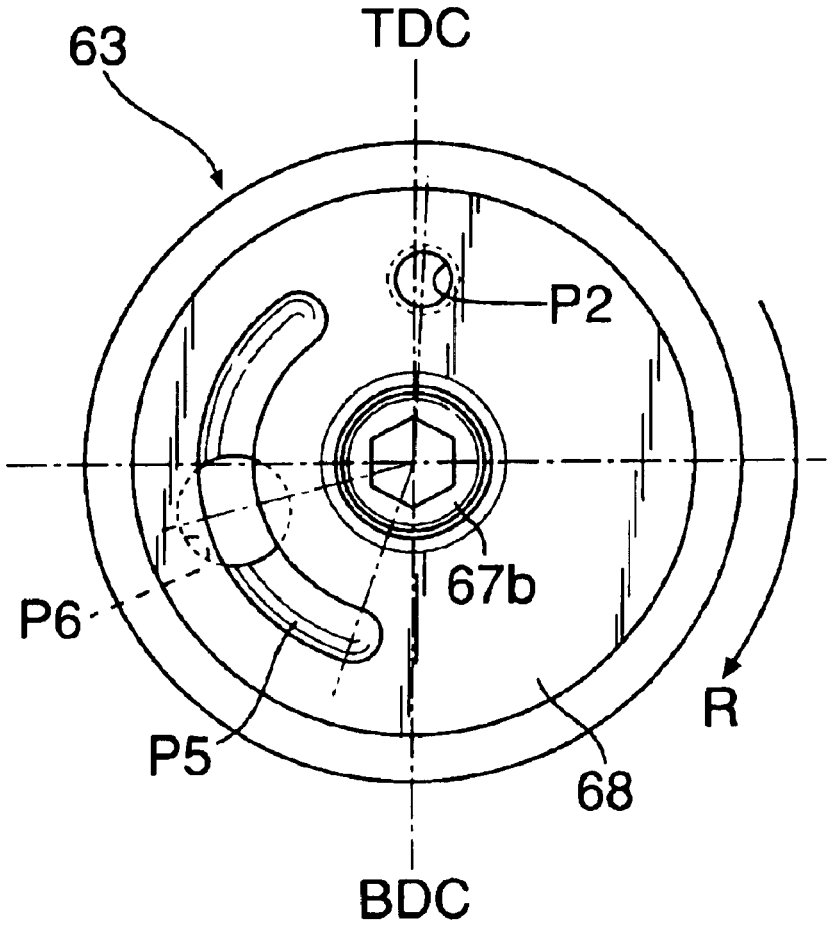

As shown in FIG. 4, a rotary valve 61 is housed in a circular cross-section recess 27*b* opening on the rear end surface of the rotor 27 and a circular cross-section recess 18*a* opening on a front surface of the rear cover 18. The rotary valve 61, which is disposed along the axis L, includes a rotary valve main body 62, a stationary valve plate 63, and a movable valve plate 64. The movable valve plate 64 is fixed to the rotor 27 via a knock pin 66 and a bolt 67*a* in a state in which it is fitted to the base of the recess 27*b* of the rotor 27 via a gasket 65. The stationary valve plate 63, which abuts against the movable valve plate 64 via a flat sliding surface 68, is joined via a knock pin 69 and a bolt 67*b* to the rotary valve main body 62 so that there is no relative rotation therebetween. When the rotor 27 rotates, the movable valve plate 64 and the stationary valve plate 63 therefore rotate relative to each other on the sliding surface 68 in a state in which they are in intimate contact with each other. The stationary valve plate 63 and the movable valve plate 64 are made of a material having excellent durability, such as a super hard alloy or a ceramic, and the sliding surface 68 can be provided with or coated with a member having heat resistance, lubricating properties, corrosion resistance, or abrasion resistance.

The rotary valve main body 62 is a stepped cylindrical member having a large diameter part 62*a*, a medium diameter part 62*b*, and a small diameter part 62*c*; an annular sliding member 70 fitted around the outer periphery of the large diameter part 62*a* is slidably fitted in the recess 27*b* of the rotor 27 via a cylindrical sliding surface 71, and the medium diameter part 62*b* and the small diameter part 62*c* are fitted in the recess 18*a* of the rear cover 18 via seals 72 and 73. The sliding member 70 is made of a material having excellent durability, such as a super hard alloy or a ceramic. A knock pin 74 implanted in the outer periphery of the rotary valve main body 62 engages with a long hole 18*b* formed in the recess 18*a* of the rear cover 18 in the axis L direction, and the rotary valve main body 62 is therefore supported so that it can move in the axis L direction but cannot rotate relative to the rear cover 18.

A plurality of (for example, seven) preload springs 75 are supported in the rear cover 18 so as to surround the axis L, and the rotary valve main body 62, which has a step 62*d* between the medium diameter part 62*b* and the small diameter part 62*c* pressed by these preload springs 75, is biased forward so as to make the sliding surface 68 of the stationary valve plate 63 and the movable valve plate 64 come into intimate contact with each other. A pressure chamber 76 is defined between the bottom of the recess 18*a* of the rear cover 18 and the rear end surface of the small diameter part 62*c* of the rotary valve main body 62, and a steam supply pipe 77 connected so as to run though the rear cover 18 communicates with the pressure chamber 76. The rotary valve main body 62 is therefore biased forward by the steam pressure acting on the pressure chamber 76 in addition to the resilient force of the preload springs 75.

Figure 16:
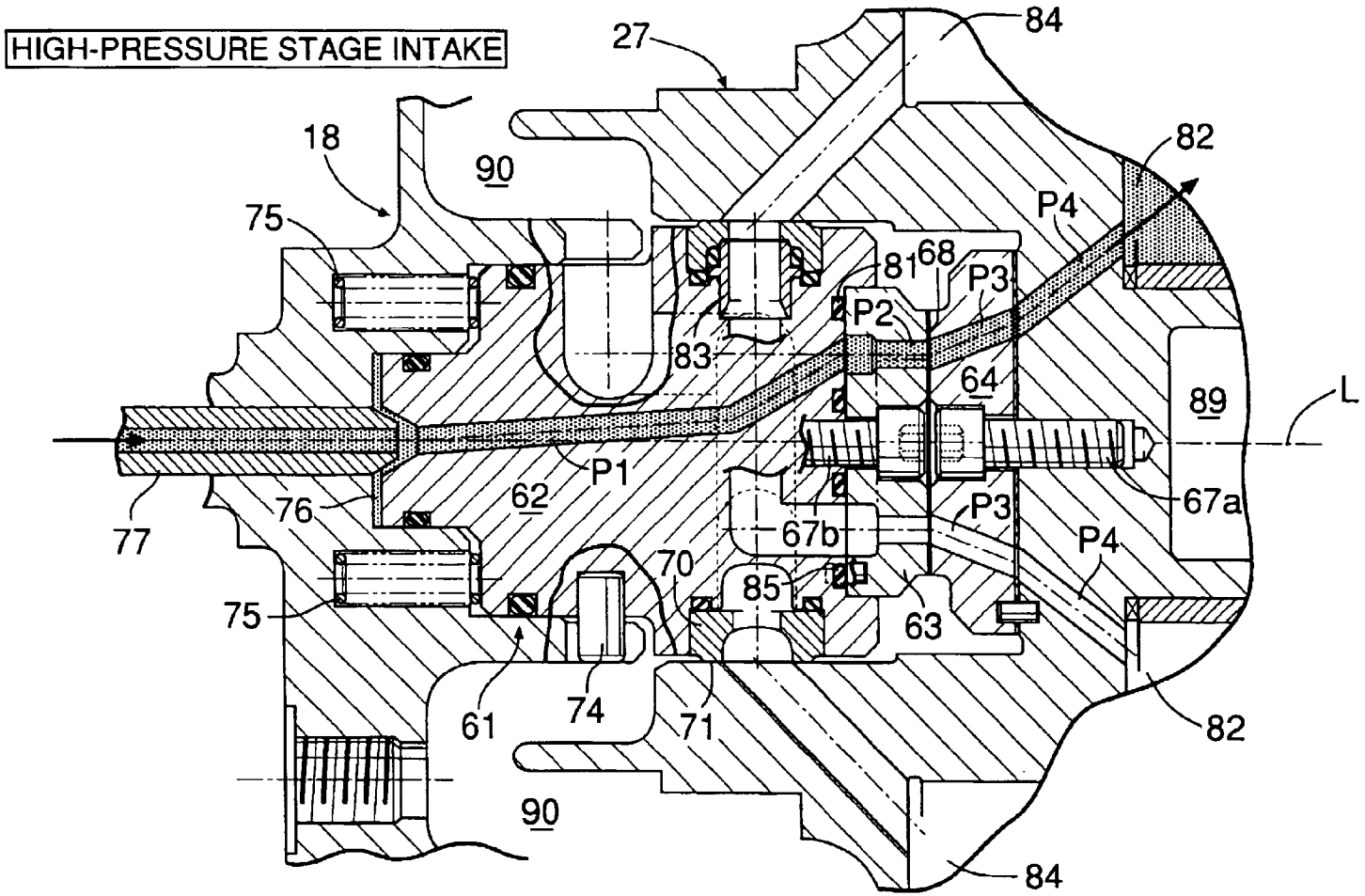

A high-pressure stage steam intake route for supplying high-temperature, high-pressure steam to the first axial piston cylinder group 49 is shown in FIG. 16 by a mesh pattern. As is clear from FIG. 16 together with FIG. 5 to FIG. 9, a first steam passage P1 having its upstream end communicating with the pressure chamber 76, to which the high-temperature, high-pressure steam is supplied from the steam supply pipe 77, runs through the rotary valve main body 62, opens on the surface at which the rotary valve main body 62 is joined to the stationary valve plate 63, and communicates with a second steam passage P2 running through the stationary valve plate 63. In order to prevent the steam from leaking past the surface at which the rotary valve main body 62 and the stationary valve plate 63 are joined, the joining surface is equipped with a seal 81 (see FIG. 7 and FIG. 16), which seals the outer periphery of a connecting part between the first and second steam passages P1 and P2.

Seven third steam passages P3 (see FIG. 5) and seven fourth steam passages P4 are formed respectively in the movable valve plate 64 and the rotor 27 at circumferentially equal intervals, and the downstream ends of the fourth steam passages P4 communicate with the seven high-pressure operating chambers 82 defined between the high-pressure cylinders 42 and the high-pressure pistons 43 of the first axial piston cylinder group 49. As is clear from FIG. 6, an opening of the second steam passage P2 formed in the stationary valve plate 63 does not open evenly to the front and rear of the top dead center (TDC) of the high-pressure pistons 43, but opens displaced slightly forward in the direction of rotation of the rotor 27, which is shown by the arrow R. This enables as long an expansion period as possible, that is, a sufficient expansion ratio, to be maintained, negative work, which would be generated if the opening were set evenly to the front and rear of the TDC, to be minimized and, moreover, the expanded steam remaining in the high-pressure operating chambers 82 to be reduced, thus providing sufficient output (efficiency).

Figure 17:
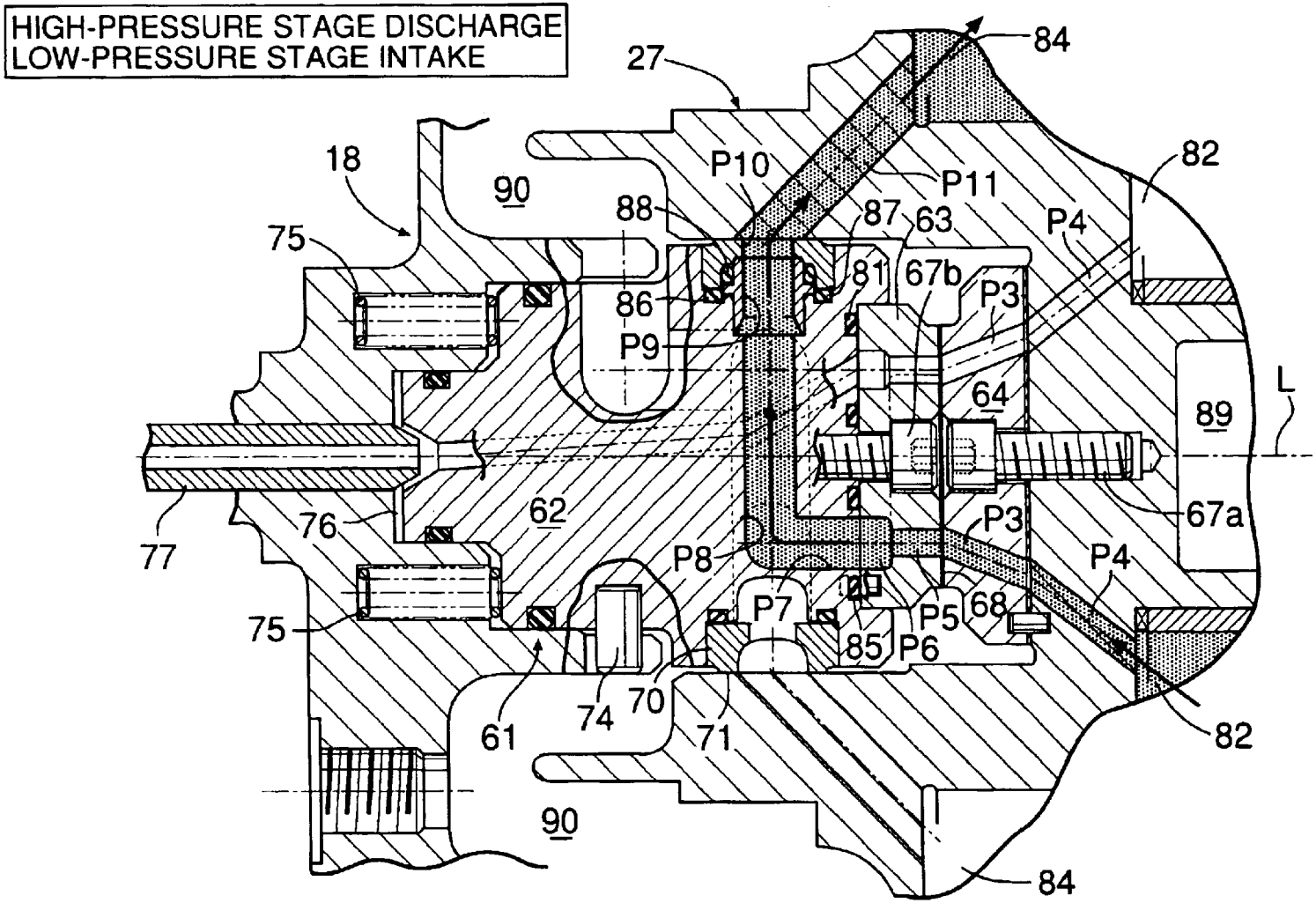

A high-pressure stage steam discharge route and a low-pressure stage steam intake route for discharging medium-temperature, medium-pressure steam from the first axial piston cylinder group 49 and supplying it to the second axial piston cylinder group 57 are shown in FIG. 17 by a mesh pattern. As is clear from FIG. 17 together with FIG. 5 to FIG. 8, an arc-shaped fifth steam passage P5 (see FIG. 6) opens on a front surface of the stationary valve plate 63, and this fifth steam passage P5 communicates with a circular sixth steam passage P6 (see FIG. 7) opening on a rear surface of the stationary valve plate 63. The fifth steam passage P5 opens from a position displaced slightly forward in the direction of rotation of the rotor 27, which is shown by the arrow R, relative to the bottom dead center (BDC) of the high-pressure pistons 43 to a position displaced slightly backward in the rotational direction relative to the TDC. This enables the third steam passages P3 of the movable valve plate 64 to communicate with the fifth steam passage P5 of the stationary valve plate 63 over an angular range that starts from the BDC and does not overlap the second steam passage P2 (preferably, immediately before overlapping the second steam passage P2), and in this range the steam is discharged from the third steam passages P3 to the fifth steam passage P5.

Formed in the rotary valve main body 62 are a seventh steam passage P7 extending in the axis L direction and an eighth steam passage P8 extending in a substantially radial direction. The upstream end of the seventh steam passage P7 communicates with the downstream end of the sixth steam passage P6. The downstream end of the seventh steam passage P7 communicates with a tenth steam passage P10 running radially through the sliding member 70 via a ninth steam passage P9 within a coupling member 83 disposed so as to bridge between the rotary valve main body 62 and the sliding member 70. The tenth steam passage P10 communicates with the seven low-pressure operating chambers 84 defined between the low-pressure cylinders 50 and the low-pressure pistons 41 of the second axial piston cylinder group 57 via seven eleventh steam passages P11 formed radially in the rotor 27.

Figure 7:
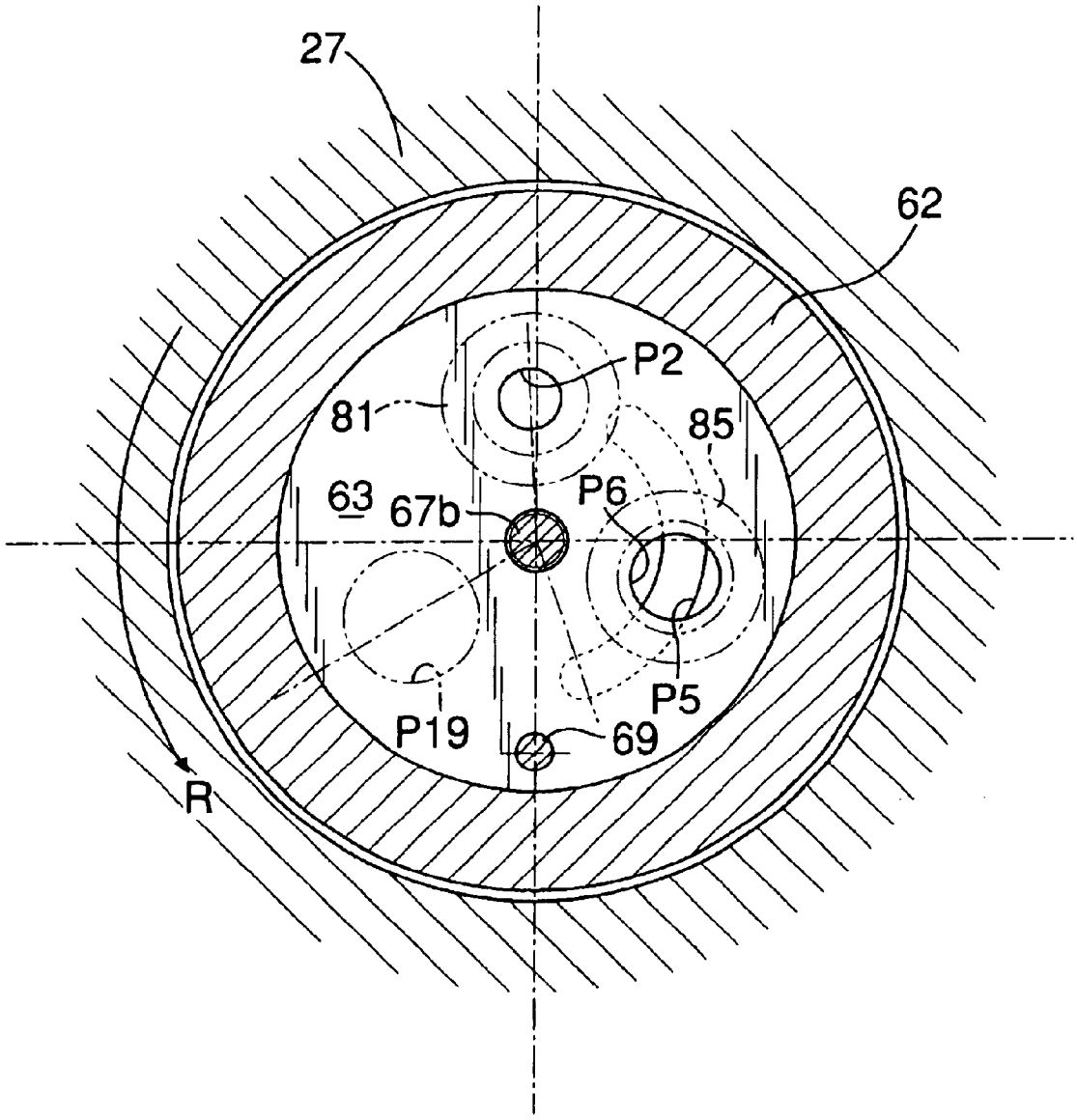
Figure 8:
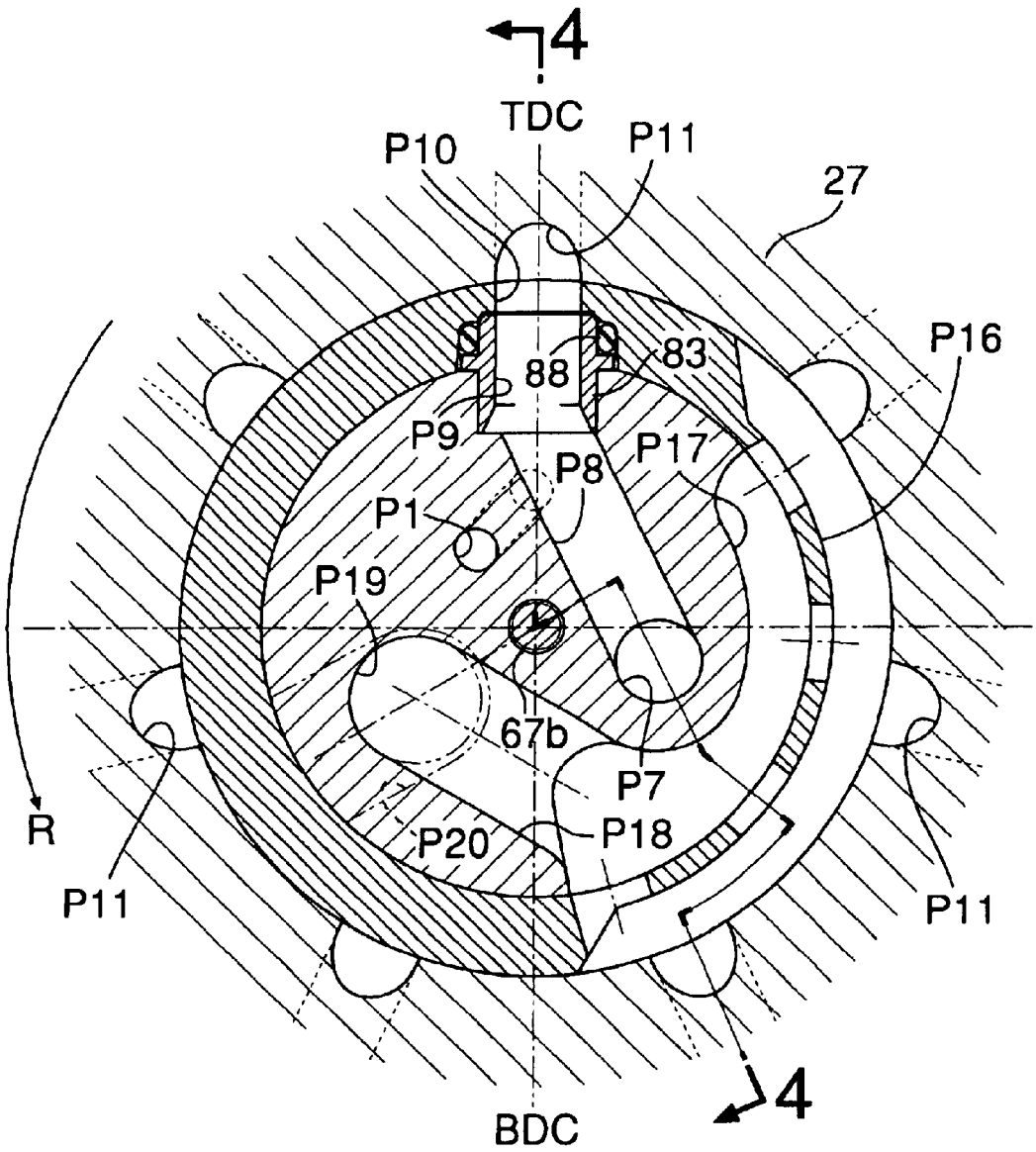
Figure 9:
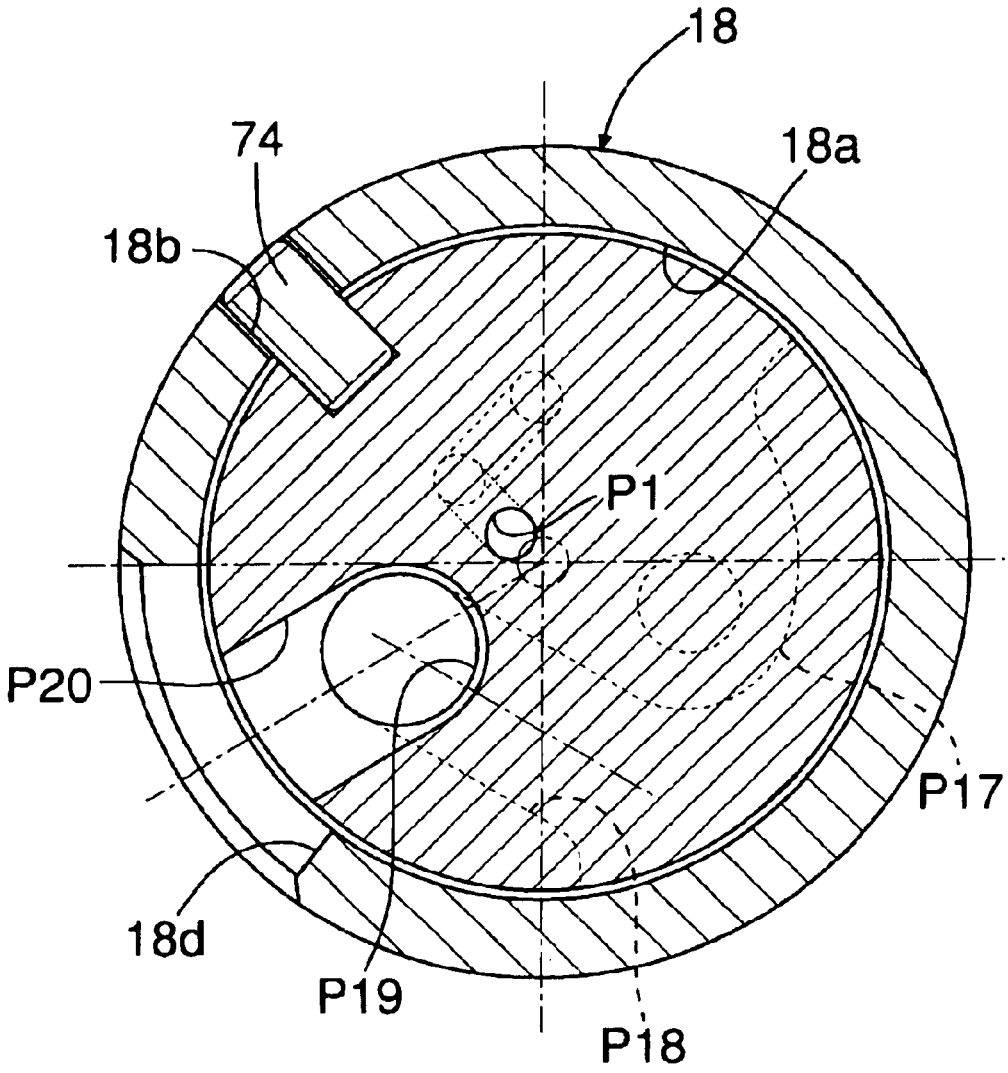
Figure 10:
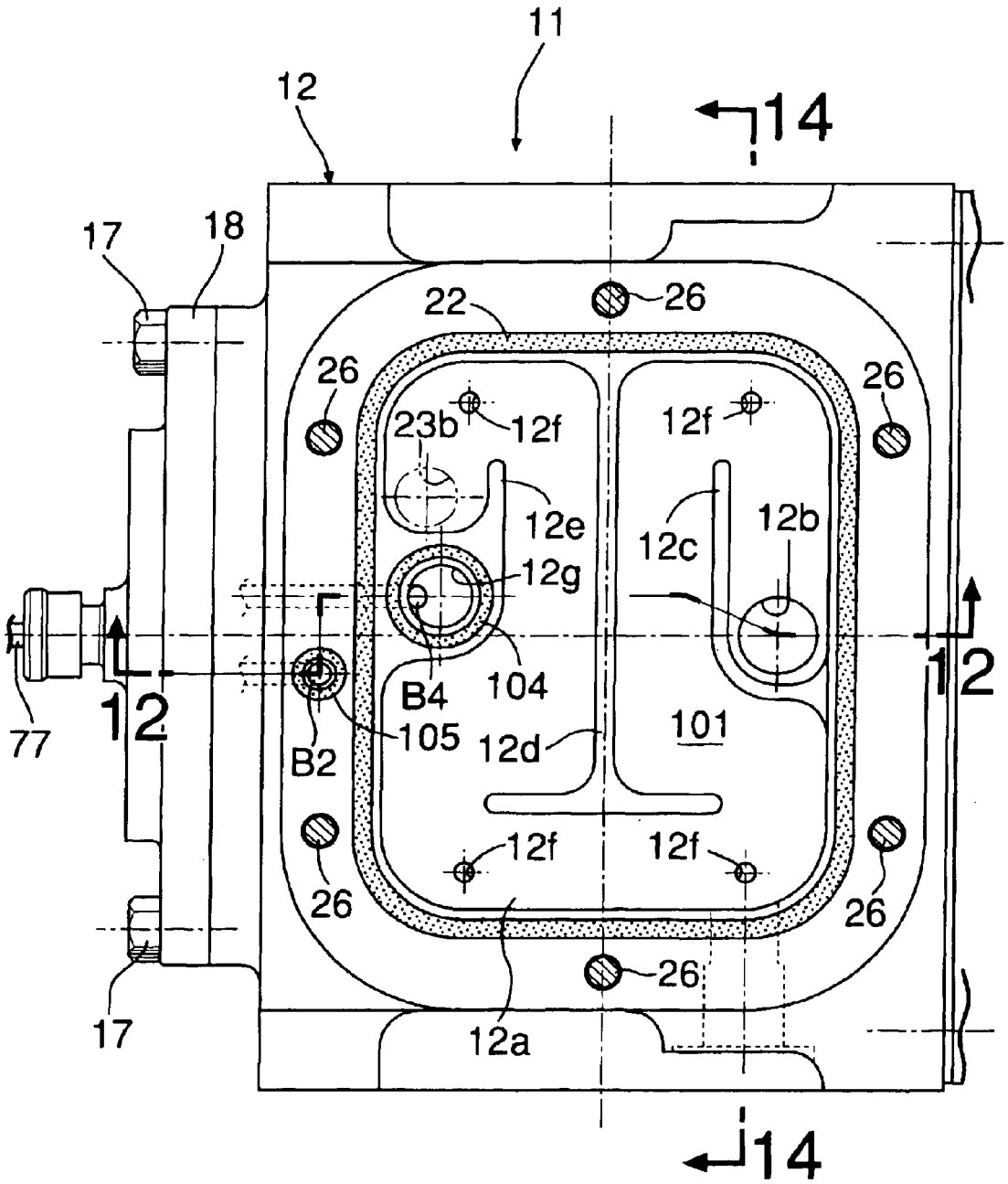
Figure 11:
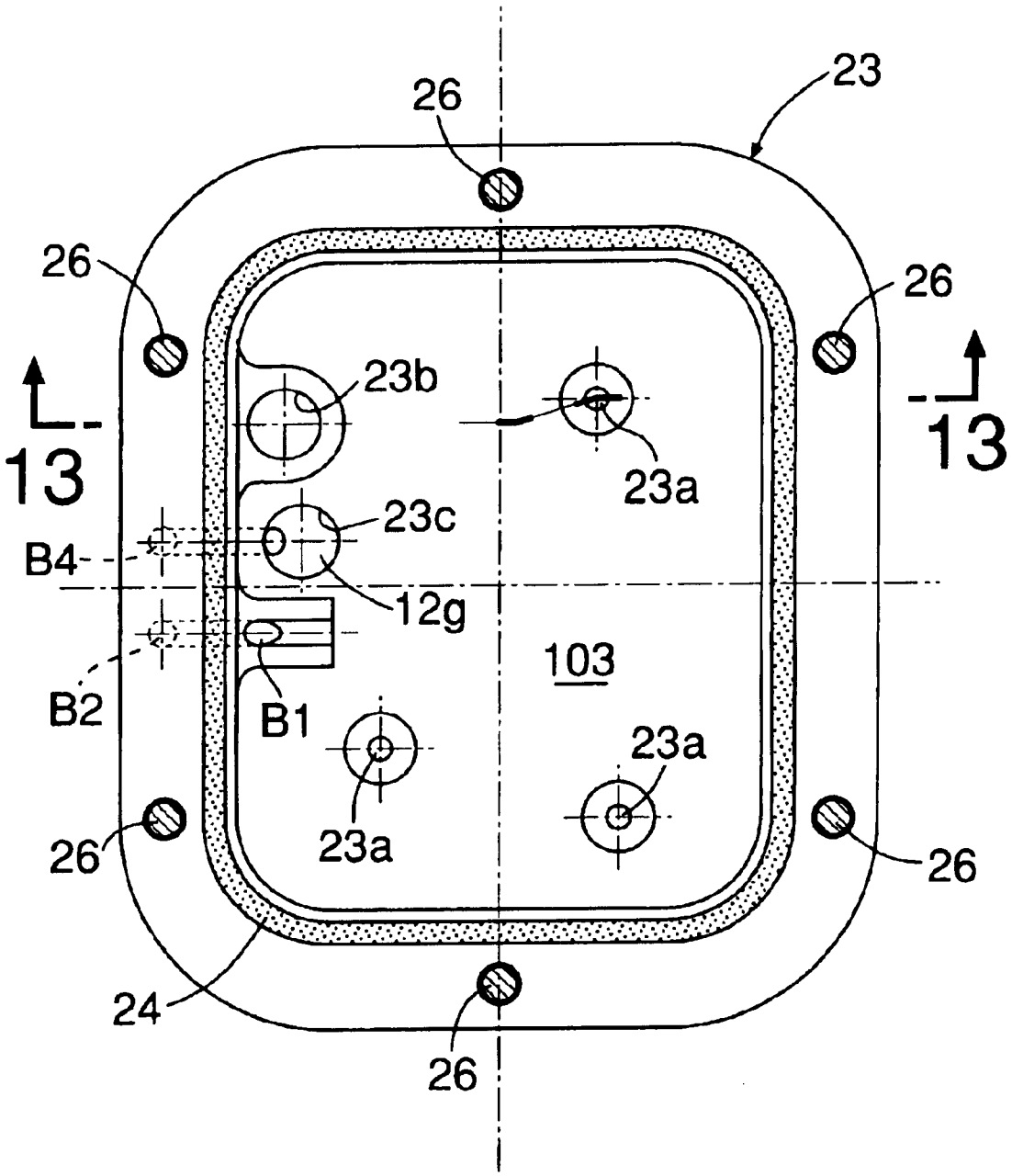

In order to prevent the steam from leaking past the joining surfaces of the rotary valve main body 62 and the stationary valve plate 63, the outer periphery of a part where the sixth and seventh steam passages P6 and P7 are connected is sealed by equipping the joining surfaces with a seal 85 (see FIG. 7 and FIG. 17). Two seals 86 and 87 are disposed between the inner periphery of the sliding member 70 and the rotary valve main body 62, and a seal 88 is disposed between the outer periphery of the coupling member 83 and the sliding member 70.

Figure 18:
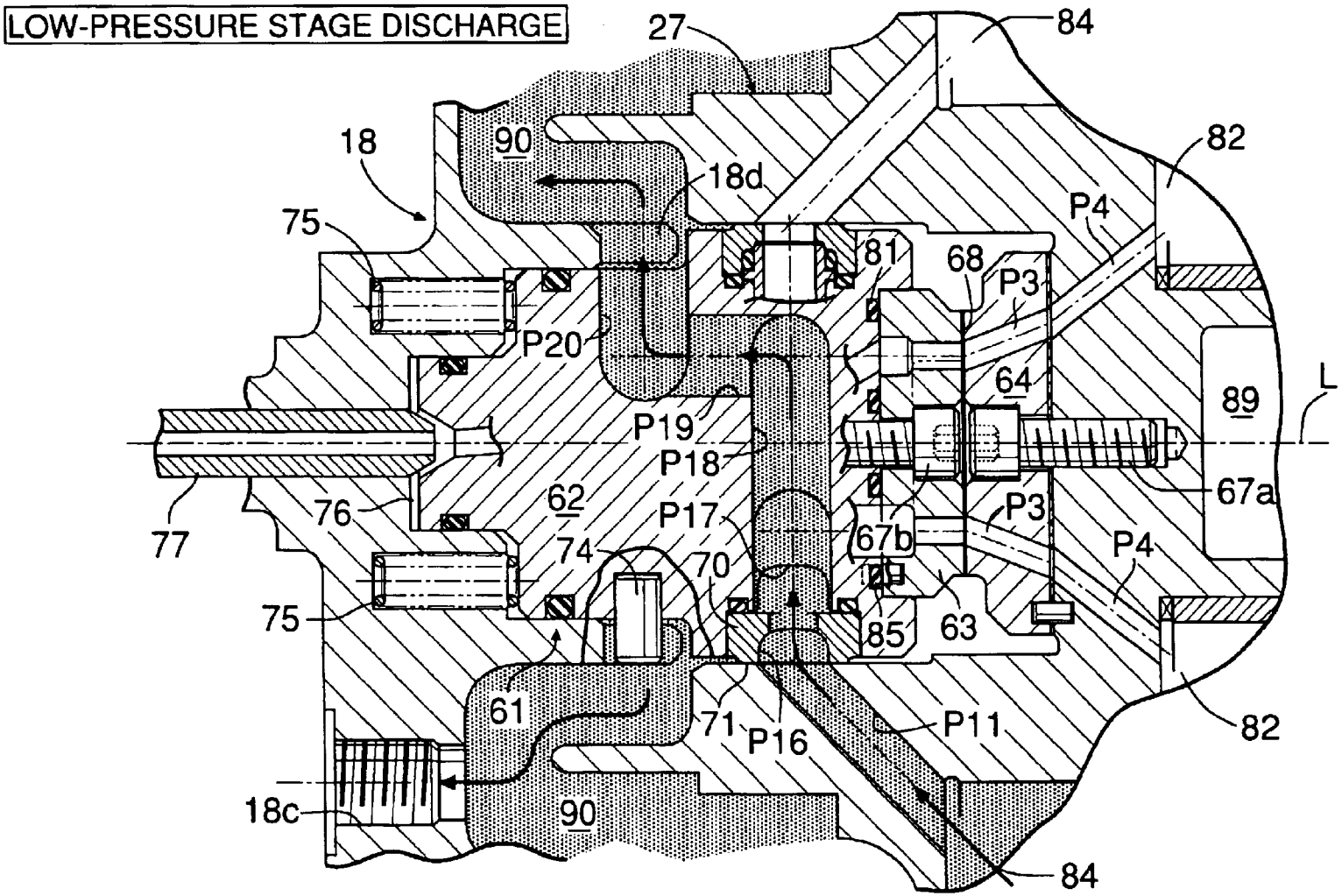

A steam discharge route for discharging low-temperature, low-pressure steam from the second axial piston cylinder group 57 is shown in FIG. 18 by a mesh pattern. As is clear from reference to FIG. 18 together with FIG. 8 and FIG. 9, an arc-shaped sixteenth steam passage P16 that can communicate with the seven eleventh steam passages P11 formed in the rotor 27 is cut out in the sliding surface 71 of the sliding member 70. This sixteenth steam passage P16 communicates with a seventeenth steam passage P17 that is cut out in an arc-shape in the outer periphery of the rotary valve main body 62. The sixteenth steam passage P16 opens from a position displaced slightly forward in the direction of rotation of the rotor 27, which is shown by the arrow R, relative to the BDC of the low-pressure pistons 51 to a position displaced slightly backward in the direction of rotation of the rotor 27 relative to the TDC. This allows the eleventh steam passages P11 of the rotor 27 to communicate with the sixteenth steam passage P16 of the sliding member 70 over an angular range that starts from the BDC and does not overlap the tenth steam passage P10 (preferably, immediately before overlapping the tenth steam passage P10), and in this range the steam is discharged from the eleventh steam passages P11 to the sixteenth steam passage P16.

The seventeenth steam passage P17 further communicates with a steam discharge chamber 90 formed between the rotary valve main body 62 and the rear cover 18 via an eighteenth steam passage P18 to a twentieth steam passage P20 formed within the rotary valve main body 62 and a cutout 18*d* of the rear cover 18, and this steam discharge chamber 90 communicates with a steam discharge hole 18*c* formed in the rear cover 18.

As hereinbefore described, since the supply and discharge of the steam to and from the first axial piston cylinder group 49 and the supply and discharge of the steam to and from the second axial piston cylinder group 57 are controlled by the common rotary valve 61, in comparison with a case in which separate rotary valves are used for each, the dimensions of the expander 113 can be reduced. Moreover, since a valve for supplying the high-temperature, high-pressure steam to the first axial piston cylinder group 49 is formed on the flat sliding surface 68 on the front end of the stationary valve plate 63, which is integral with the rotary valve main body 62, it is possible to prevent effectively the high-temperature, high-pressure steam from leaking. This is because the flat sliding surface 68 can be machined easily with high precision, and control of clearance is easier than for a cylindrical sliding surface.

In particular, since the plurality of preload springs 75 apply a preset load to the rotary valve main body 62 and bias it forward in the axis L direction, and the high-temperature, high-pressure steam supplied from the steam supply pipe 77 to the pressure chamber 76 biases the rotary valve main body 62 forward in the axis L direction, a surface pressure is generated on the sliding surface 68 between the stationary valve plate 63 and the movable valve plate 64 in response to the pressure of the high-temperature, high-pressure steam, and it is thus possible to prevent yet more effectively the steam from leaking past the sliding surface 68.

Although a valve for supplying the medium-temperature, medium-pressure steam to the second axial piston cylinder group 57 is formed on the cylindrical sliding surface 71 on the outer periphery of the rotary valve main body 62, since the pressure of the medium-temperature, medium-pressure steam passing through the valve is lower than the pressure of the high-temperature, high-pressure steam, leakage of the steam can be suppressed to a practically acceptable level by maintaining a predetermined clearance even without generating a surface pressure on the sliding surface 71.

Furthermore, since the first steam passage P1 through which the high-temperature, high-pressure steam passes, the seventh steam passage P7 and the eighth steam passage P8 through which the medium-temperature, medium-pressure steam passes, and the seventeenth steam passage P17 to the twentieth steam passage P20 through which the low-temperature, low-pressure steam passes are collectively formed within the rotary valve main body 62, not only can the steam temperature be prevented from dropping, but also the parts (for example, the seal 81) sealing the high-temperature, high-pressure steam can be cooled by the low-temperature, low-pressure steam, thus improving the durability.

Moreover, since the rotary valve 61 can be attached to and detached from the casing main body 12 merely by removing the rear cover 18 from the casing main body 12, the ease of maintenance operations such as repair, cleaning, and replacement can be greatly improved. Furthermore, although the temperature of the rotary valve 61 through which the high-temperature, high-pressure steam passes becomes high, since the swash plate 39 and the output shaft 28, where lubrication by oil is required, are disposed on the opposite side to the rotary valve 61 relative to the rotor 27, the oil is prevented from being heated by the heat of the rotary valve 61 when it is at high temperature, which would degrade the performance in lubricating the swash plate 39 and the output shaft 28. Moreover, the oil can exhibit a function of cooling the rotary valve 61, thus preventing overheating.

Figure 1:
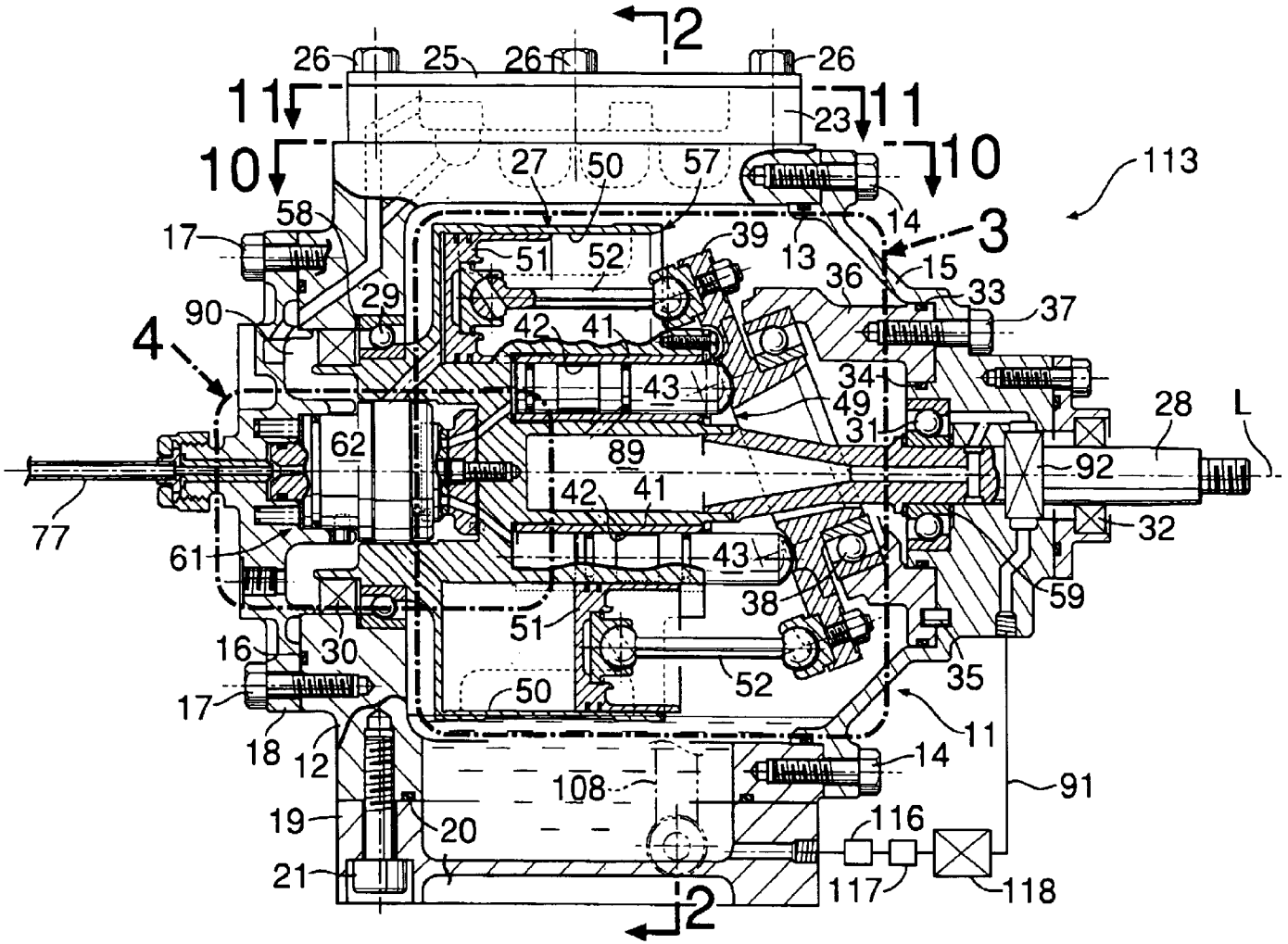

As is clear from FIG. 1, the oil that is stored in the oil pan 19 is returned to the expander 113 via an oil passage 91, an oil pump 92 driven by the output shaft 28, and an oil reservoir 89 formed within the output shaft 28, and during this process water contained in the oil is separated. The details thereof will be explained later.

The structure of a breather is now explained by reference to FIG. 10 to FIG. 14.

A lower breather chamber 101 defined between an upper wall 12*a* of the casing main body 12 and the breather chamber dividing wall 23 communicates with a lubrication chamber 102 within the casing 11 via a through hole 12*b* formed in the upper wall 12*a* of the casing main body 12. Oil is stored in the oil pan 19 provided in a bottom part of the lubrication chamber 102, and the oil level is slightly higher than the lower end of the rotor 27 (see FIG. 1). Provided within the lower breather chamber 101 so as to project upward are three dividing walls 12*c* to 12*e* having their upper ends in contact with a lower surface of the breather chamber dividing wall 23. The through hole 12*b* opens at one end of a labyrinth formed by these dividing walls 12*c* to 12*e*, and four oil return holes 12*f* running through the upper wall 12*a* are formed partway along the route to the other end of the labyrinth. The oil return holes 12*f* are formed at the lowest position of the lower breather chamber 101 (see FIG. 14), and the oil condensed within the lower breather chamber 101 can therefore be reliably returned to the lubrication chamber 102.

An upper breather chamber 103 is defined between the breather chamber dividing wall 23 and the breather chamber cover 25, and this upper breather chamber 103 communicates with the lower breather chamber 101 via four through holes 23*a* and 23*b* running through the breather chamber dividing wall 23 and projecting chimney-like within the upper breather chamber 103. A recess 12*g* is formed in the upper wall 12*a* of the casing main body 12 at a position below a condensed water return hole 23*c* running through the breather chamber dividing wall 23, and the periphery of the recess 12*g* is sealed by a seal 104.

One end of a first breather passage B1 formed in the breather chamber dividing wall 23 opens at mid height in the upper breather chamber 103. The other end of the first breather passage B1 communicates with the steam discharge chamber 90 via a second breather passage B2 formed in the casing main body 12 and a third breather passage B3 formed in the rear cover 18. Furthermore, the recess 12*g*, which is formed in the upper wall 12*a*, communicates with the steam discharge chamber 90 via a fourth breather passage B4 formed in the casing main body 12 and the third breather passage B3. The outer periphery of a part providing communication between the first breather passage B1 and the second breather passage B2 is sealed by a seal 105.

Figure 2:
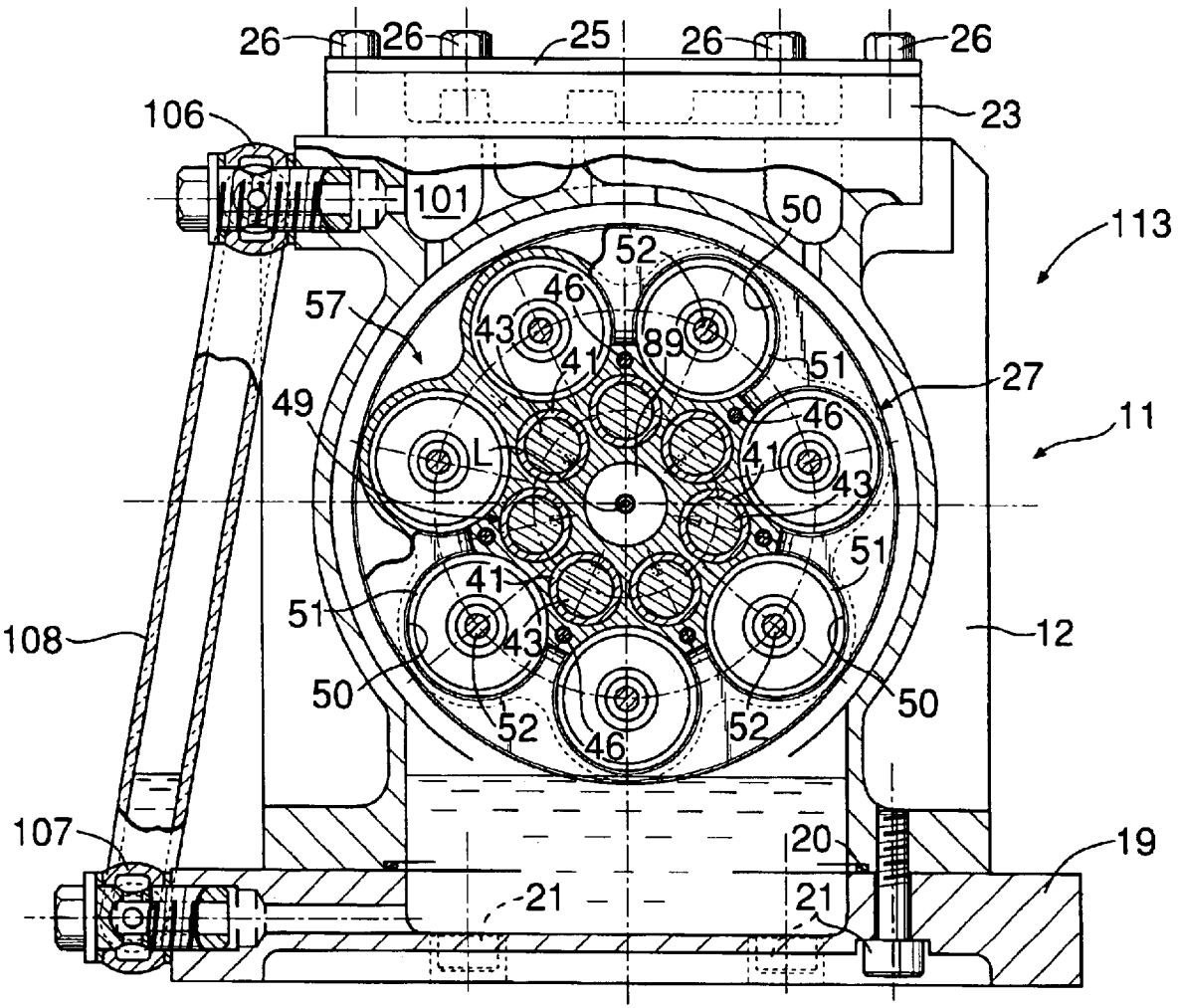
Figure 3:
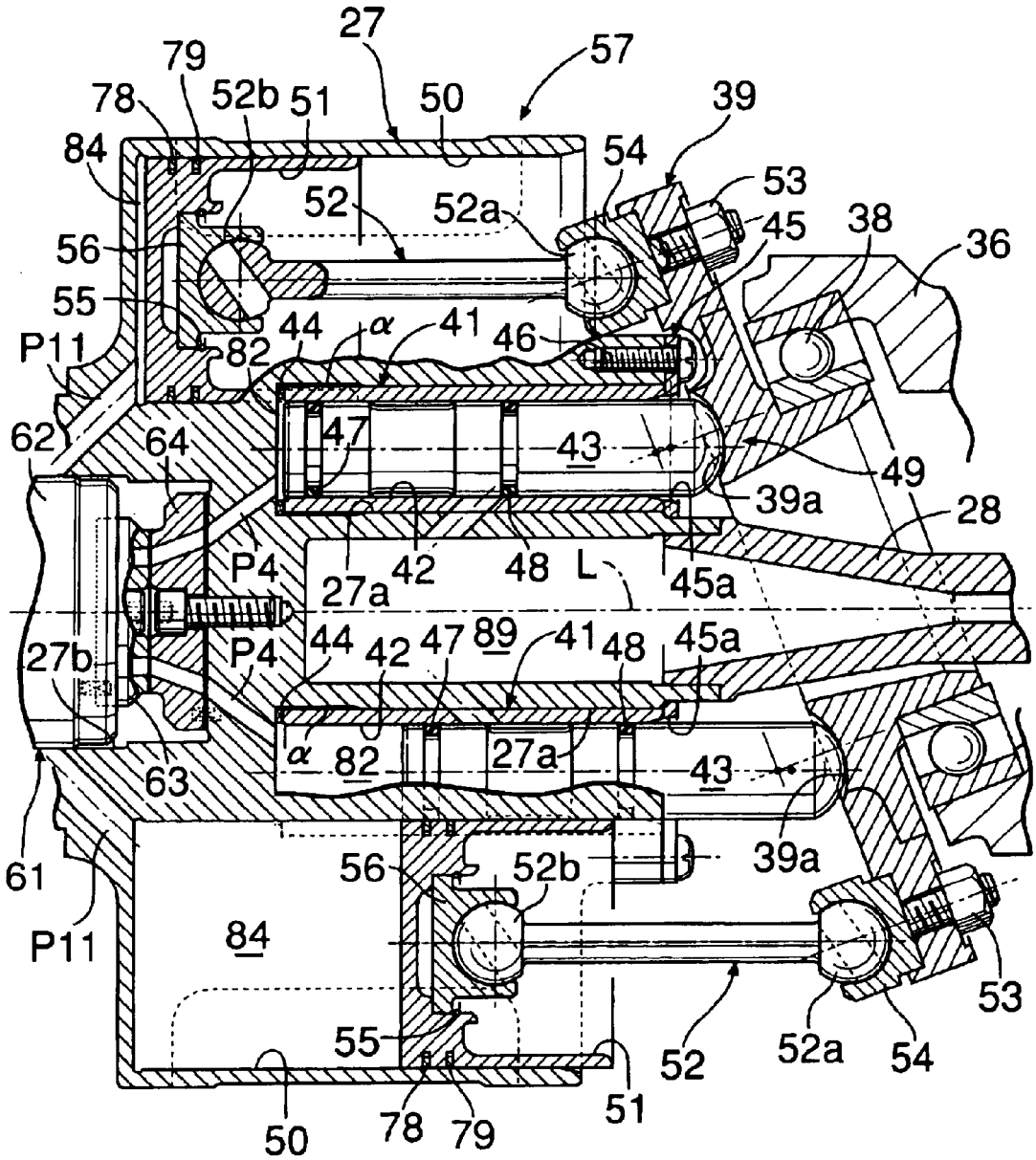

As shown in FIG. 2, a coupling 106 communicating with the lower breather chamber 101 and a coupling 107 communicating with the oil pan 19 are connected together by a transparent oil level gauge 108, and the oil level within the lubrication chamber 102 can be checked from the outside by the oil level of this oil level gauge 108. That is, the lubrication chamber 102 has a sealed structure, it is difficult to insert an oil level gauge from the outside from the viewpoint of maintaining sealing characteristics, and the structure will inevitably become complicated. However, this oil level gauge 108 enables the oil level to be checked easily from the outside while maintaining the lubrication chamber 102 in a sealed state.

The operation of the expander 113 having the above-mentioned arrangement is now explained.

As shown in FIG. 16, high-temperature, high-pressure steam generated by heating water in an evaporator is supplied to the pressure chamber 76 of the expander 113 via the steam supply pipe 77, and reaches the sliding surface 68 with the movable valve plate 64 via the first steam passage P1 formed in the rotary valve main body 62 of the rotary valve 61 and the second steam passage P2 formed in the stationary valve plate 63 integral with the rotary valve main body 62. The second steam passage P2 opening on the sliding surface 68 communicates momentarily with the third steam passage P3 formed in the movable valve plate 64 rotating integrally with the rotor 27, and the high-temperature, high-pressure steam is supplied, via the fourth steam passage P4 formed in the rotor 27, from the third steam passage P3 to, among the seven high-pressure operating chambers 82 of the first axial piston cylinder group 49, the high-pressure operating chamber 82 that is present at the top dead center.

Even after the communication between the second steam passage P2 and the third steam passage P3 has been blocked due to rotation of the rotor 27, the high-temperature, high-pressure steam expands within the high-pressure operating chamber 82 and causes the high-pressure piston 43 fitted in the high-pressure cylinder 42 of the sleeve 41 to be pushed forward from top dead center toward bottom dead center, and the front end of the high-pressure piston 43 presses against the dimple 39*a* of the swash plate 39. As a result, the reaction force that the high-pressure pistons 43 receive from the swash plate 39 gives a rotational torque to the rotor 27. For each one seventh of a revolution of the rotor 27, the high-temperature, high-pressure steam is supplied into a fresh high-pressure operating chamber 82, thus continuously rotating the rotor 27.

As shown in FIG. 17, while the high-pressure piston 43, which has reached bottom dead center, moves back toward top dead center accompanying rotation of the rotor 27, the medium-temperature, medium-pressure steam pushed out of the high-pressure operating chamber 82 is supplied to the eleventh steam passage P11 communicating with the low-pressure operating chamber 84 that, among the second axial piston cylinder group 57, has reached top dead center accompanying rotation of the rotor 27, via the fourth steam passage P4 of the rotor 27, the third steam passage P3 of the movable valve plate 64, the sliding surface 68, the fifth steam passage P5 and the sixth steam passage P6 of the stationary valve plate 63, the seventh steam passage P7 to the tenth steam passage P10 of the rotary valve main body 62, and the sliding surface 71. Since the medium-temperature, medium-pressure steam supplied to the low-pressure operating chamber 84 expands within the low-pressure operating chambers 84 even after the communication between the tenth steam passage P10 and the eleventh steam passage P11 is blocked, the low-pressure piston 51 fitted in the low-pressure cylinder 50 is pushed forward from top dead center toward bottom dead center, and the link 52 connected to the low-pressure piston 51 presses against the swash plate 39. As a result, the pressure force of the low-pressure piston 51 is converted into a rotational force of the swash plate 39 via the link 52, and this rotational force transmits a rotational torque from the high-pressure piston 43 to the rotor 27 via the dimple 39*a* of the swash plate 39. That is, the rotational torque is transmitted to the rotor 27, which rotates synchronously with the swash plate 39. In order to prevent the low-pressure piston 51 from becoming detached from the swash plate 39 when a negative pressure is generated during the expansion stroke, the link 52 carries out a function of maintaining a connection between the low-pressure piston 51 and the swash plate 39, and it is arranged that the rotational torque due to the expansion is transmitted from the high-pressure piston 43 to the rotor 27 rotating synchronously with the swash plate 39 via the dimples 39*a* of the swash plate 39 as described above. For each one seventh of a revolution of the rotor 27, the medium-temperature, medium-pressure steam is supplied into a fresh low-pressure operating chamber 84, thus continuously rotating the rotor 27.

As shown in FIG. 18, while the low-pressure piston 51, which has reached bottom dead center, moves back toward top dead center accompanying rotation of the rotor 27, the low-temperature, low-pressure steam pushed out of the low-pressure operating chamber 84 is discharged into the steam discharge chamber 90 via the eleventh steam passage P11 of the rotor 27, the sliding surface 71, the sixteenth steam passage P16 of the sliding member 70, and the seventeenth steam passage P17 to the twentieth steam passage P20 of the rotary valve main body 62, and is supplied therefrom into a condenser via the steam discharge hole 18*c*.

Figure 15:
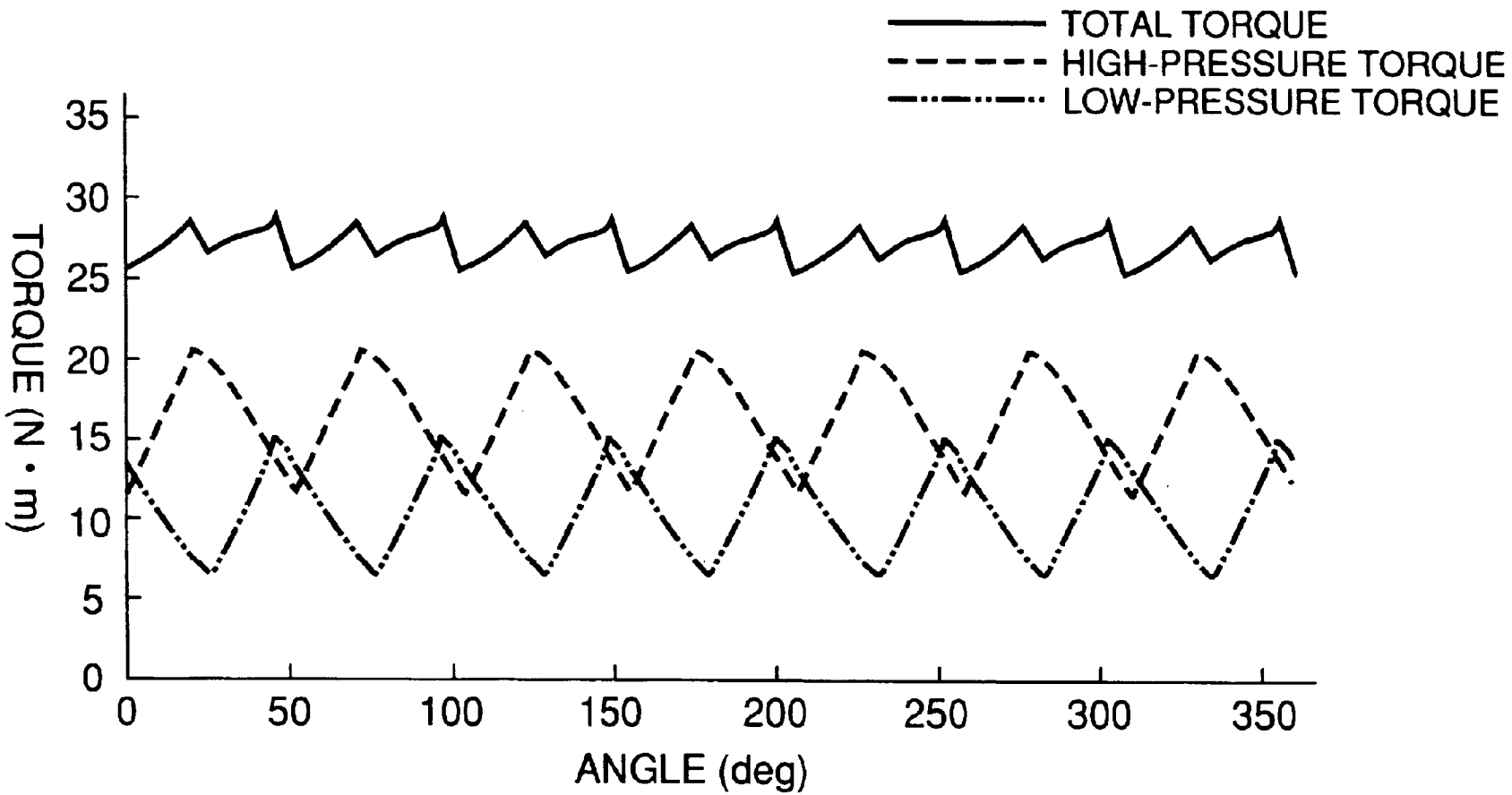

When the expander 113 operates as described above, since the seven high-pressure pistons 43 of the first axial piston cylinder group 49 and the seven low-pressure pistons 51 of the second axial piston cylinder group 57 are connected to the common swash plate 39, the outputs of the first and second axial piston cylinder groups 49 and 57 can be combined to drive the output shaft 28, thereby achieving a high output while reducing the size of the expander 113. During this process, since the seven high-pressure pistons 43 of the first axial piston cylinder group 49 and the seven high-pressure pistons 51 of the second axial piston cylinder group 57 are displaced by half a pitch in the circumferential direction, as shown in FIG. 15, pulsations in the output torque of the first axial piston cylinder group 49 and pulsations in the output torque of the second axial piston cylinder group 57 balance each other out, thus making the output torque of the output shaft 28 flat.

Furthermore, although axial type rotary fluid machines characteristically have a higher space efficiency than radial type rotary fluid machines, by arranging two stages in the radial direction the space efficiency can be further enhanced. In particular, since the axial piston cylinders of the first group 49, which are required to have only a small diameter because they are operated by high-pressure steam having a small volume, are arranged on the radially inner side, and the axial piston cylinders of the second group 57, which are required to have a large diameter because they are operated by low-pressure steam having a large volume, are arranged on the radially outer side, the space can be utilized effectively, thus making the expander 113 still smaller. Moreover, since the cylinders 42 and 50 and the pistons 43 and 51 that are used have circular cross sections, which enables machining to be carried out with high precision, the amount of steam leakage can be reduced in comparison with a case in which vanes are used, and a yet higher output can thus be anticipated.

Furthermore, since the first axial piston cylinder group 49 operated by high-temperature steam is arranged on the radially inner side, and the second axial piston cylinder group 57 operated by low-temperature steam is arranged on the radially outer side, the difference in temperature between the second axial piston cylinder group 57 and the outside of the casing 11 can be minimized, the amount of heat released outside the casing 11 can be minimized, and the efficiency of the expander 113 can be enhanced. Moreover, since the heat escaping from the high-temperature first axial piston cylinder group 49 on the radially inner side can be recovered by the low-temperature second axial piston cylinder group 57 on the radially outer side, the efficiency of the expander 113 can be further enhanced.

Moreover, when viewed from an angle perpendicular to the axis L, since the rear end of the first axial piston cylinder group 49 is positioned forward relative to the rear end of the second axial piston cylinder group 57, heat escaping rearward in the axis L direction from the first axial piston cylinder group 49 can be recovered by the second axial piston cylinder group 57, and the efficiency of the expander 113 can be yet further enhanced. Furthermore, since the sliding surface 68 on the high-pressure side is present deeper within the recess 27*b* of the rotor 27 than the sliding surface 71 on the low-pressure side, the difference in pressure between the outside of the casing 11 and the sliding surface 71 on the low-pressure side can be minimized, the amount of steam leaking past the sliding surface 71 on the low-pressure side can be reduced and, moreover, the pressure of steam leaking past the sliding surface 68 on the high-pressure side can be recovered by the sliding surface 71 on the low-pressure side and utilized effectively.

During operation of the expander 113, the oil accumulated in the oil pan 19 is stirred and splashed by the rotor 27 rotating within the lubrication chamber 102 of the casing 11, thereby lubricating sliding sections between the high-pressure cylinders 42 and the high-pressure pistons 43, sliding sections between the low-pressure cylinders 50 and the low-pressure pistons 51, the angular ball bearing 31 supporting the output shaft 28, the angular ball bearing 29 supporting the rotor 27, the angular ball bearing 38 supporting the swash plate 39, sliding sections between the high-pressure pistons 43 and the swash plate 39, the spherical bearings 54 and 56 at opposite ends of the links 52, etc.

The interior of the lubrication chamber 102 is filled with oil mist generated by splashing due to stirring of the oil and oil vapor generated by vaporization due to heating by a high-temperature section of the rotor 27, and this is mixed with steam leaking into the lubrication chamber 102 from the high-pressure operating chambers 82 and low-pressure operating chambers 84. When the pressure of the lubrication chamber 102 becomes higher than the pressure of the steam discharge chamber 90 due to the leakage of steam, the mixture of oil content and steam flows through the through hole 12*b* formed in the upper wall 12*a* of the casing main body 12 into the lower breather chamber 101. The interior of the lower breather chamber 101 has a labyrinth structure due to the dividing walls 12*c* to 12*e*; the oil that condenses while passing therethrough drops through the four oil return holes 12*f* formed in the upper wall 12*a* of the casing main body 12, and is returned to the lubrication chamber 102.

The steam from which the oil content has been removed passes through the four through holes 23*a* and 23*b* of the breather chamber dividing wall 23, flows into the upper breather chamber 103, and condenses by losing its heat to the outside air via the breather chamber cover 25, which defines an upper wall of the upper breather chamber 103. Water that has condensed within the upper breather chamber 103 passes through the condensed water return hole 23*c* formed in the breather chamber dividing wall 23 and drops into the recess 12*g* without flowing into the four through holes 23*a*, 23*b* projecting chimney-like within the upper breather chamber 103, and is discharged therefrom into the steam discharge chamber 90 via the fourth breather passage B4 and the third breather passage B3. Here, the amount of condensed water returned into the steam discharge chamber 90 corresponds to the amount of steam that has leaked from the high-pressure operating chambers 82 and the low-pressure operating chambers 84 into the lubrication chamber 102. Furthermore, since the steam discharge chamber 90 and the upper breather chamber 103 always communicate with each other via the first steam passage B1 to the third steam passage B3, which function as pressure equilibration passages, pressure equilibrium between the steam discharge chamber 90 and the lubrication chamber 102 can be maintained.

During a transition period prior to completion of warming-up, if the pressure of the lubrication chamber 102 becomes lower than the pressure of the steam discharge chamber 90, the steam in the steam discharge chamber 90 might be expected to flow into the lubrication chamber 102 via the third breather passage B3, the second breather passage B2, the first breather passage B1, the upper breather chamber 103, and the lower breather chamber 101, but after the completion of warming-up, because of the leakage of steam into the lubrication chamber 102, the pressure of the lubrication chamber 102 becomes higher than the pressure of the steam discharge chamber 90, and the above-mentioned oil and steam separation is started.

In a Rankine cycle system in which steam (or water), which is the working medium, circulates in a closed circuit, it is necessary to avoid as much as possible the oil from being mixed with the working medium and contaminating the system; the mixing of the oil with the steam (or water) can be minimized by the lower breather chamber 101 separating the oil and the upper breather chamber 103 separating the condensed water, thus reducing the load imposed on a filter separating the oil, achieving a reduction in size and a reduction in cost, and thereby preventing contamination and degradation of the oil.

In the expander 113 employing oil as the lubricating medium for each sliding section, even by taking the above-mentioned countermeasures a small amount of water, which is the working medium, cannot be prevented from becoming mixed with the oil. Such water that has mixed with the oil degrades the lubrication performance, and it is necessary to separate the water from the oil and return the water to the closed circuit of the Rankine cycle system. On the other hand the oil, which is the lubricating medium, also cannot be prevented from becoming mixed with the water, which is the working medium, in the expander 113. If the water having the oil mixed therewith circulates around the closed circuit of the Rankine cycle system, the oil affects the performance and the durability of the evaporator and the condenser, and it is therefore necessary to separate the oil from the water and return the oil to the lubricating system of the expander 113.

The overall arrangement of the Rankine cycle system that includes the expander 113 is now explained with reference to FIG. 19.

Arranged in the working medium circulation circuit 110 of the Rankine cycle system are an evaporator 112 that generates high-temperature, high-pressure steam, which is a gas-phase working medium, by heating water, which is a liquid-phase working medium, using exhaust gas from an internal combustion engine 111 as the source of heat; the expander 113 that generates mechanical energy by the high-temperature, high-pressure steam generated by the evaporator 112; a condenser 114 that cools the decreased temperature, decreased pressure steam discharged from the expander 113 so as to turn it back into water; and a feed pump 115 that resupplies the water discharged from the condenser 114 to the evaporator 112.

The oil passage 91 through which the oil of the expander 113 is circulated by the oil pump 92 is provided with a radiator 116, a prefilter 117, and water separating means 118, and the water separated by the water separating means 118 is returned to the working medium circulation circuit 110 of the Rankine cycle system via a water return passage 120 in which a one-way valve 119 is disposed. The oil from which the water has been separated by the water separating means 118 is returned to the expander 113 via the oil passage 91 and the oil pump 92.

Figure 20:
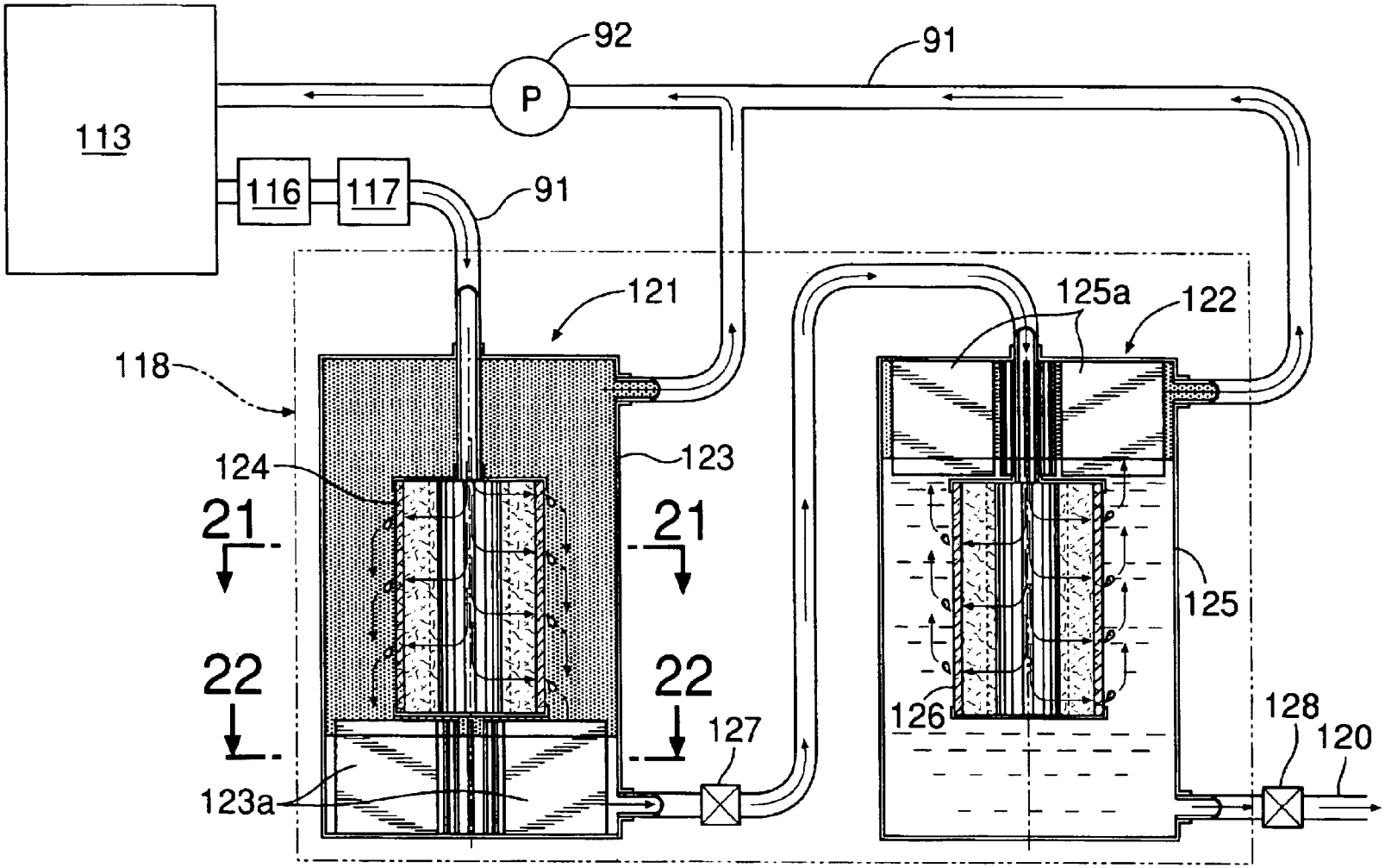
Figure 21:
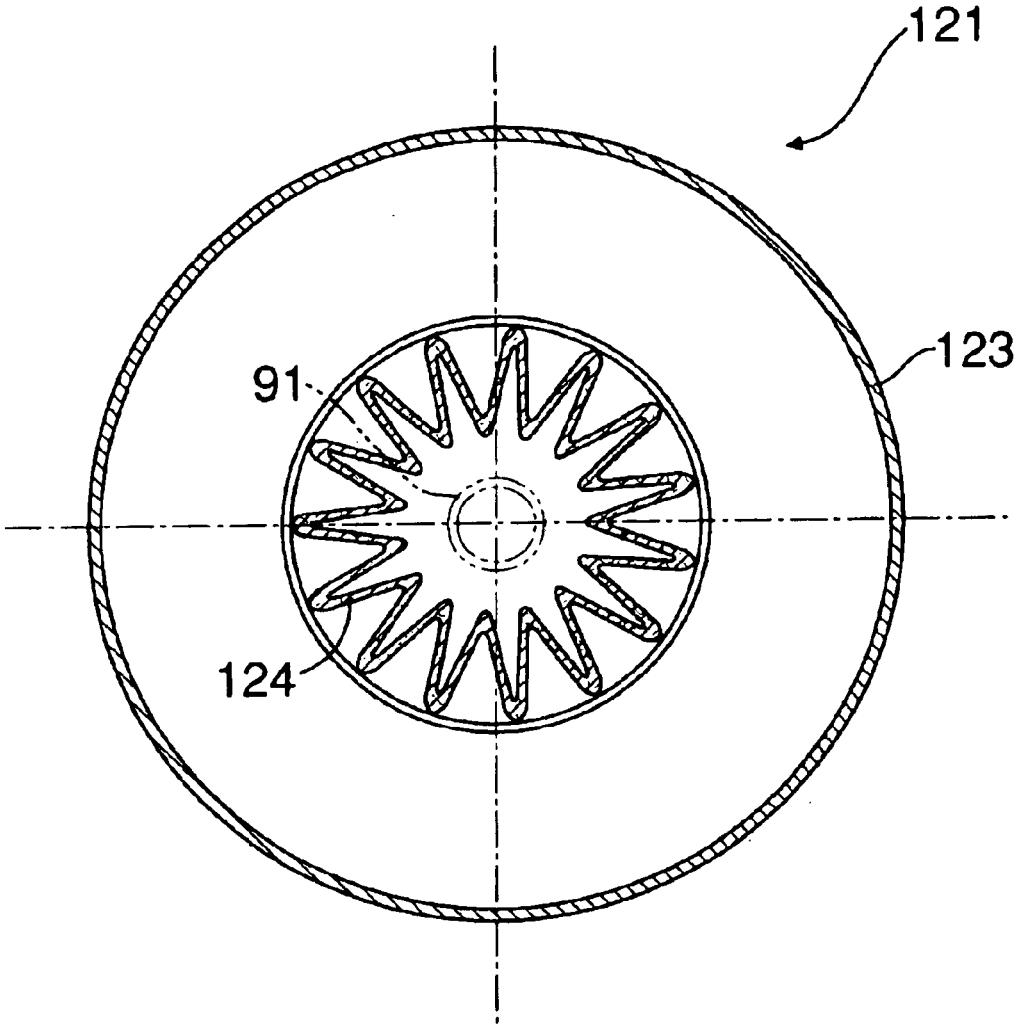
Figure 22:
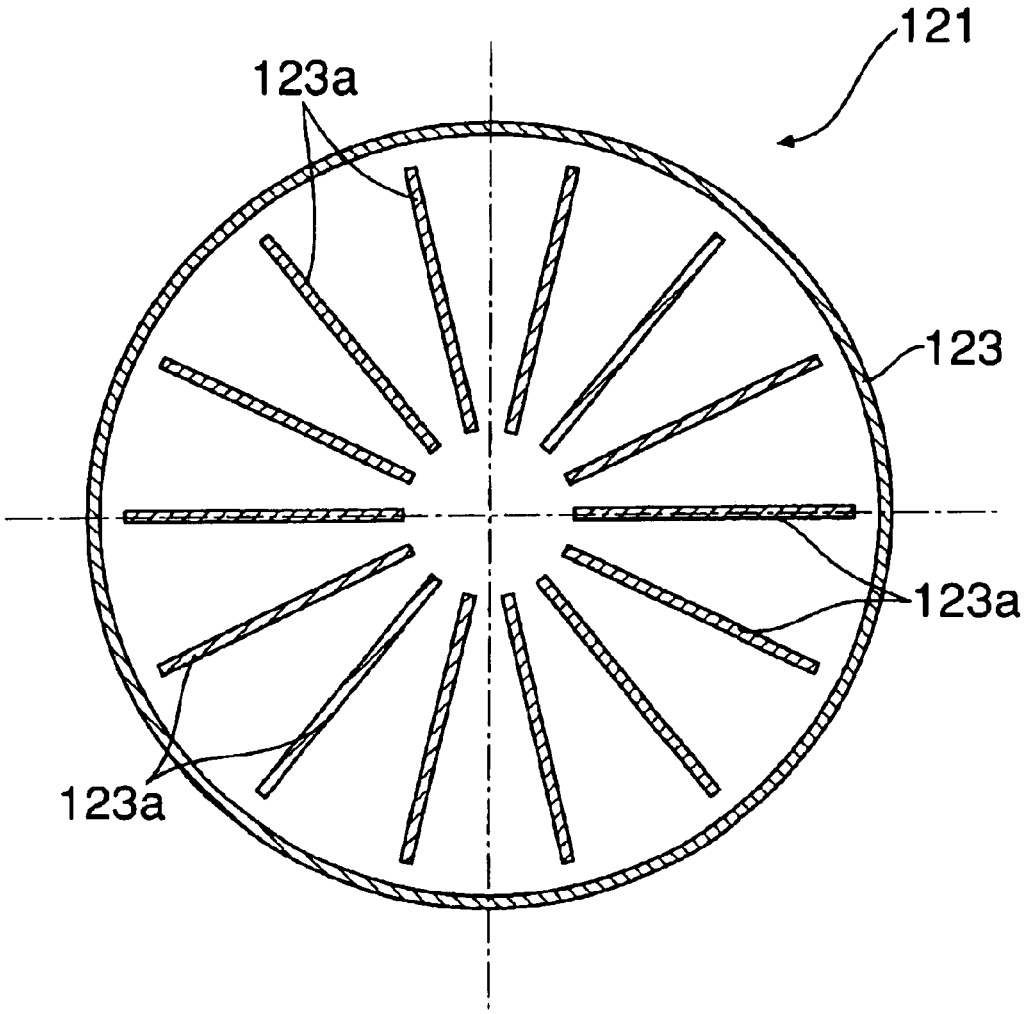

As shown in FIG. 20 to FIG. 22, the water separating means 118 is provided with a coalescer type upstream side water separating device 121 and a coalescer type downstream side water separating device 122 in line. The upstream side water separating device 121 is for separating water from an oil-water mixture in which the oil supplied from the expander 113 is mixed with a small amount of water; a hydrophilic ultrafine nylon fiber cylindrical filter element 124 is disposed within a casing 123, and the oil-water mixture is supplied into the interior of the filter element 124. The downstream side water separating device 122 is for separating oil from a water-oil mixture in which the water supplied from the upstream side water separating device 121 is mixed with a small amount of oil; a hydrophilic ultrafine nylon fiber cylindrical filter element 126 is disposed within a casing 125, and the water-oil mixture is supplied into the interior of the filter element 126. A water exit of the upstream side water separating device 121 is provided with an upstream side switch valve 127, and a water exit of the downstream side water separating device 122 is provided with a downstream side switch valve 128.

Figures 23A, 23B:
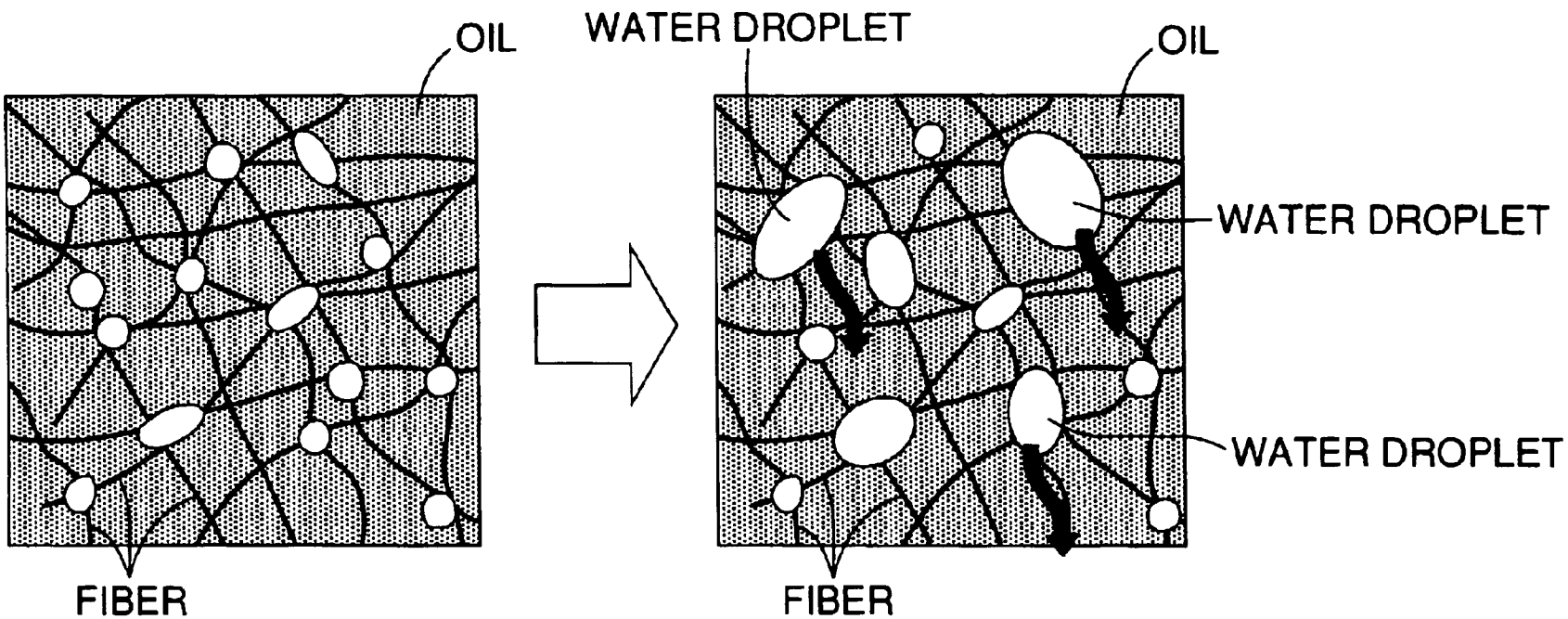
FIGS. 23A and 23B are diagrams showing the operation of a coalescer type filter for separating water.

The upstream side switch valve 127 and the downstream side switch valve 128 are normally closed; by supplying in this state from the expander 113 the oil-water mixture in which the oil is mixed with a small amount of water, as is clear from FIGS. 23A and 23B, while the oil-water mixture passes from the inside to the outside through the filter element 124 of the upstream side water separating device 121, the small amount of water contained in the oil is captured by the ultrafine nylon fiber and gradually increases its size, and when it turns into water droplets having a diameter of on the order of 2 to 3 mm, the water droplets alone fall downward due to the difference in specific gravity between water and the oil, which is lighter than water, thus being separated from the oil, which goes upward. The oil from which water has been separated is returned to the lubrication system of the expander 113 by the oil pump 92 disposed in the oil passage 91.

In order to prevent the water that has been collected at the bottom of the casing 123 of the upstream side water separating device 121 from mixing again with the oil due to vibration, etc. accompanying travel of an automobile equipped with the Rankine cycle system, a large number of partitions 123*a* are provided on the bottom of the casing 123 so as to suppress free flow of the water. Instead of these partitions 123*a*, it is also possible to arrange a material having excellent water absorptivity such as a sponge on the bottom of the casing 123, and free flow of water can be suppressed by absorbing the water with the material.

Figures 24A, 24B:
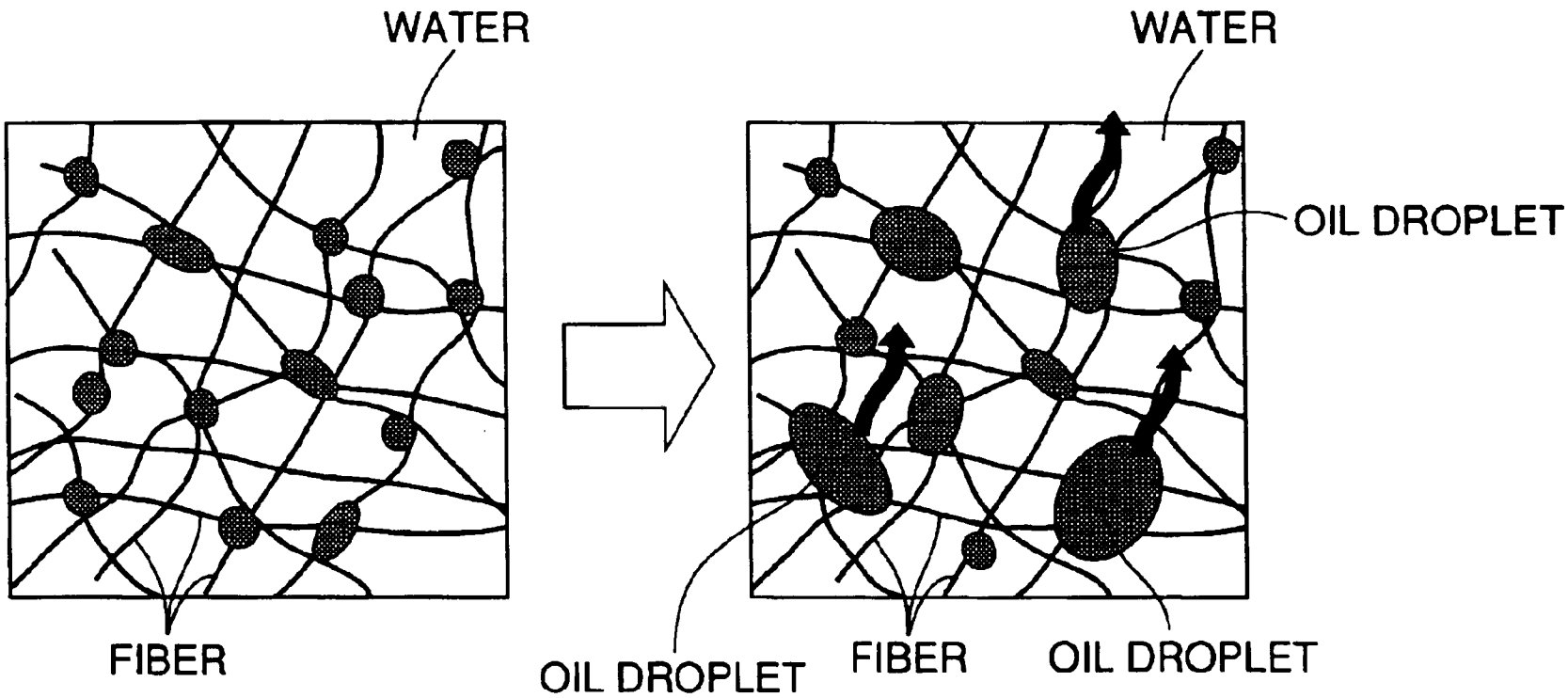
FIGS. 24A and 24B are diagrams showing the operation of a coalescer type filter for separating oil.

In this way, when the amount of water that has been collected at the bottom of the upstream side water separating device 121 increases, before the water mixes again with the oil that is to be returned to the expander 113, the upstream side switch valve 127 is opened so as to supply the water that has been collected at the bottom of the upstream side water separating device 121 to the downstream side water separating device 122. Since the water that has been collected at the bottom of the upstream side water separating device 121 still contains a small amount of oil, the oil is further separated in the downstream side water separating device 122. As is clear from FIGS. 24A and 24B, in the downstream side water separating device 122, when the water-oil mixture passes from the inside to the outside through the filter element 126, the small amount of oil contained in the water is captured by the ultrafine nylon fiber and gradually increases its size, and when it turns into oil droplets having a diameter of on the order of 2 to 3 mm, the oil droplets alone float upward due to the difference in specific gravity between the water and the oil, which is lighter than the water, thus being separated from the water, which goes downward.

In order to prevent the oil that has been collected at the top of the casing 125 of the downstream side water separating device 122 from mixing again with water due to vibration, etc. accompanying travel of an automobile equipped with the Rankine cycle system, a large number of partitions 125*a* are provided at the top of the casing 125 so as to suppress free flow of the oil. Instead of these partitions 125*a*, it is also possible to arrange a sponge, etc., thus obtaining the same effects.

The oil that has been separated from the water-oil mixture in the downstream side water separating device 122 is returned to the lubrication system of the expander 113 by means of the oil pump 92 disposed in the oil passage 91. When a predetermined amount of water from which the oil has been separated has been collected at the bottom of the downstream side water separating device 122, the downstream side switch valve 128 opens, and the water is returned to the working medium circulation circuit 110 of the Rankine cycle system via the water return passage 120 in which the one-way valve 119 is disposed. During this process, by closing the downstream side switch valve 128 before the water that has been collected at the bottom of the downstream side water separating device 122 is completely discharged, the oil can be prevented from flowing into the working medium circulation circuit 110 of the Rankine cycle system.

Control of the opening and closing of the upstream side switch valve 127 and the downstream side switch valve 128 can be carried out on the basis of the oil content of the water that is collected in, for example, the upstream side water separating device 121 and the downstream side water separating device 122. More specifically, since water is electrically conductive and oil is electrically nonconductive, as the oil content of the water increases, the electrical resistance increases, and the oil content can be detected based on this.

The nylon fiber-made filter elements 124 and 126 of the upstream side water separating device 121 and the downstream side water separating device 122 have a heat resistant temperature of about 80° C., whereas the temperature of the oil residing in the oil pan 19 of the expander 113 reaches about 120° C. Therefore, by reducing the temperature of the oil to the heat resistant temperature of the filter elements 124 and 126 or lower by means of the radiator 116 provided on the upstream side of the water separating means 118, it is possible to ensure that the upstream side water separating device 121 and the downstream side water separating device 122 function, and increase the durability.

Moreover, since the working medium contained in the oil that has passed through the radiator 116 is cooled so as to become liquid-phase state water, in comparison with a case in which the oil is separated from the working medium in a state in which steam and water are mixed, the water separation performance of the water separating means 118 can be enhanced. Furthermore, by removing dust from the oil-water mixture by means of the prefilter 117 downstream of the radiator 116, clogging of the filter elements 124 and 126 of the upstream side water separating device 121 and the downstream side water separating device 122 can be prevented, thereby increasing the durability. It is also possible for the water separating means 118 to be mounted outside the expander 113 and separately from the expander 113, or for it to be integrated with the expander 113.

When the amount of steam supplied to the expander 113 changes according to the output state of the internal combustion engine 111 and, furthermore, if the internal combustion engine 111 has just started and warm-up of the expander 113 has not been completed, since the amount of steam leaking past the clearance of each of the sliding sections also increases, the mixing ratio of the oil-water mixture supplied from the expander 113 to the water separating means 118 also varies. In this case, when an attempt is made to separate the water from the oil using a single water separating device, there are the problems that since the capacity of the water separating device is insufficient, the oil might mix with the water thus separated, and if the capacity is increased, the dimensions of the water separating device will increase. However, as in this embodiment, by arranging the upstream side water separating device 121 and the downstream side water separating device 122, which have different characteristics, in two stages, the water separation performance can be improved while reducing the dimensions of the water separating means 118.

Since the upstream side switch valve 127 and the downstream side switch valve 128 are normally closed, even when a large amount of oil-water mixture flows in from the expander 113 in a surge, the oil-containing water can be prevented from flowing from the water separating means 118 into the working medium circulation circuit 110 of the Rankine cycle system. Moreover, since the coalescer type water separating means 118, which carries out separation utilizing the difference in specific gravity between water and oil, has a smaller pressure loss than other membrane type filters, the load on the oil pump 92 can be alleviated.

A method for separating the water from the oil of the expander 113 is explained above, and a method for separating the oil from the water circulating in the working medium circulation circuit 110 of the Rankine cycle system is now explained below.

Figure 19:
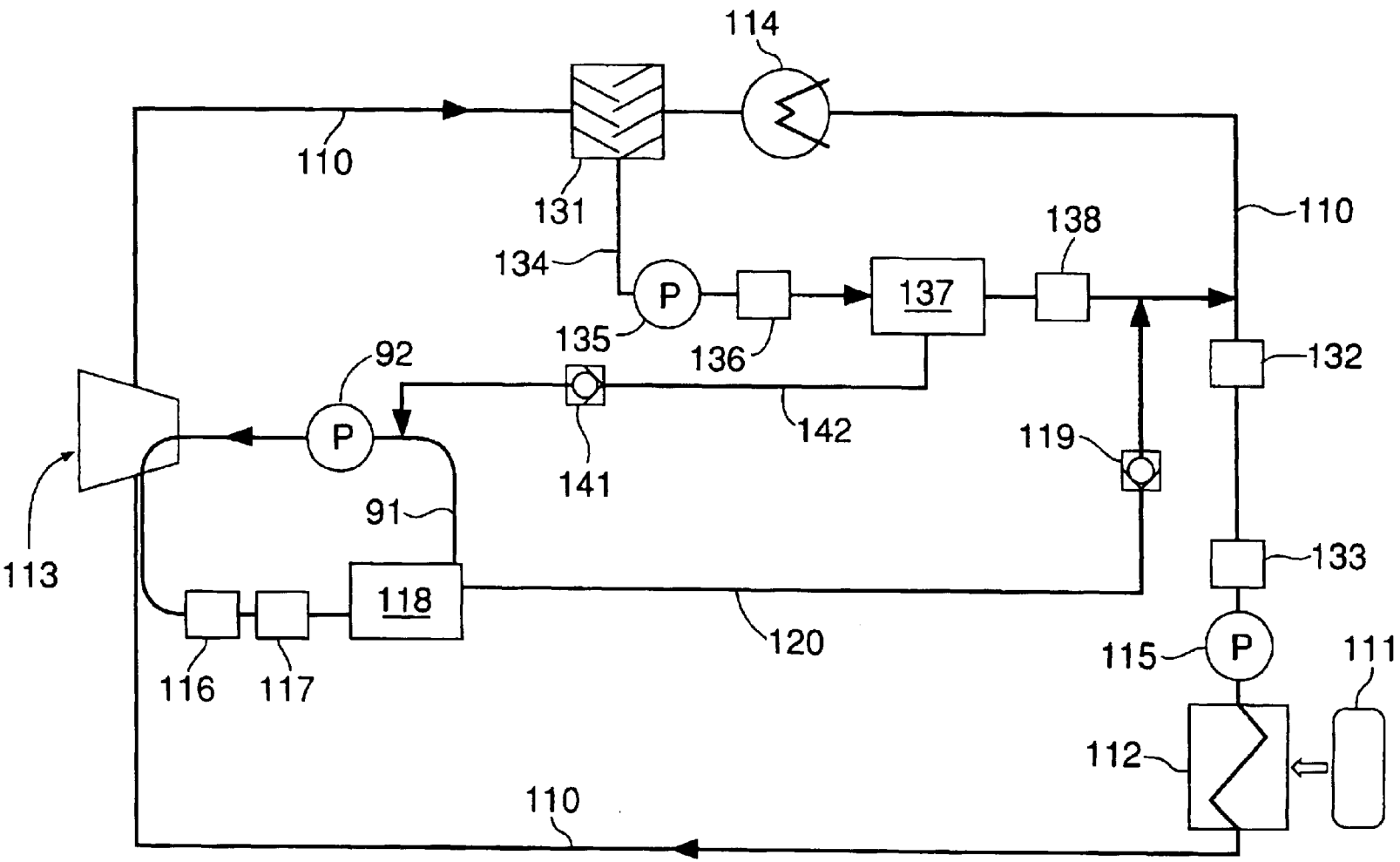

As shown in FIG. 19, disposed in line between the expander 113 and the feed pump 115 in the working medium circulation circuit 110, through which water of the Rankine cycle system circulates, are a gas/liquid separator 131, the condenser 114, water purifying means 132, and a tank 133. Disposed in line in a bypass 134 branching from the gas/liquid separator 131 and bypassing the condenser 114 are an oil pump 135*b* for feeding water-containing oil, a prefilter 136, oil separating means 137, and a filter 138.

The working medium discharged from the expander 113 is saturated steam (water-containing steam), and contains a trace amount of oil mixed therewith in the expander 113 and a trace amount of abraded powder (sludge) generated in each of the sliding sections of the expander 113. The gas/liquid separator 131 separates gas-phase steam from the saturated steam and supplies it to the condenser 114, and separates liquid-phase water containing the oil or the sludge. In this way, by separating only steam containing no oil and sludge and supplying it to the condenser 114 by means of the gas/liquid separator 131, it is possible to prevent water condensed within the condenser 114 from being cooled excessively and the condensation performance of the condenser 114 from being degraded due to contamination. In the condenser 114, degassing of non-condensed gas contained in the water is also carried out at the same time. The water containing oil and sludge separated by the gas/liquid separator 131 is supplied to the prefilter 136 by the oil pump 135*b* of the bypass 134, and comparatively large-size sludge contained in the water is removed in advance in order to prevent clogging of the oil separating means 137 on the downstream side of the prefilter 136.

Figure 25:
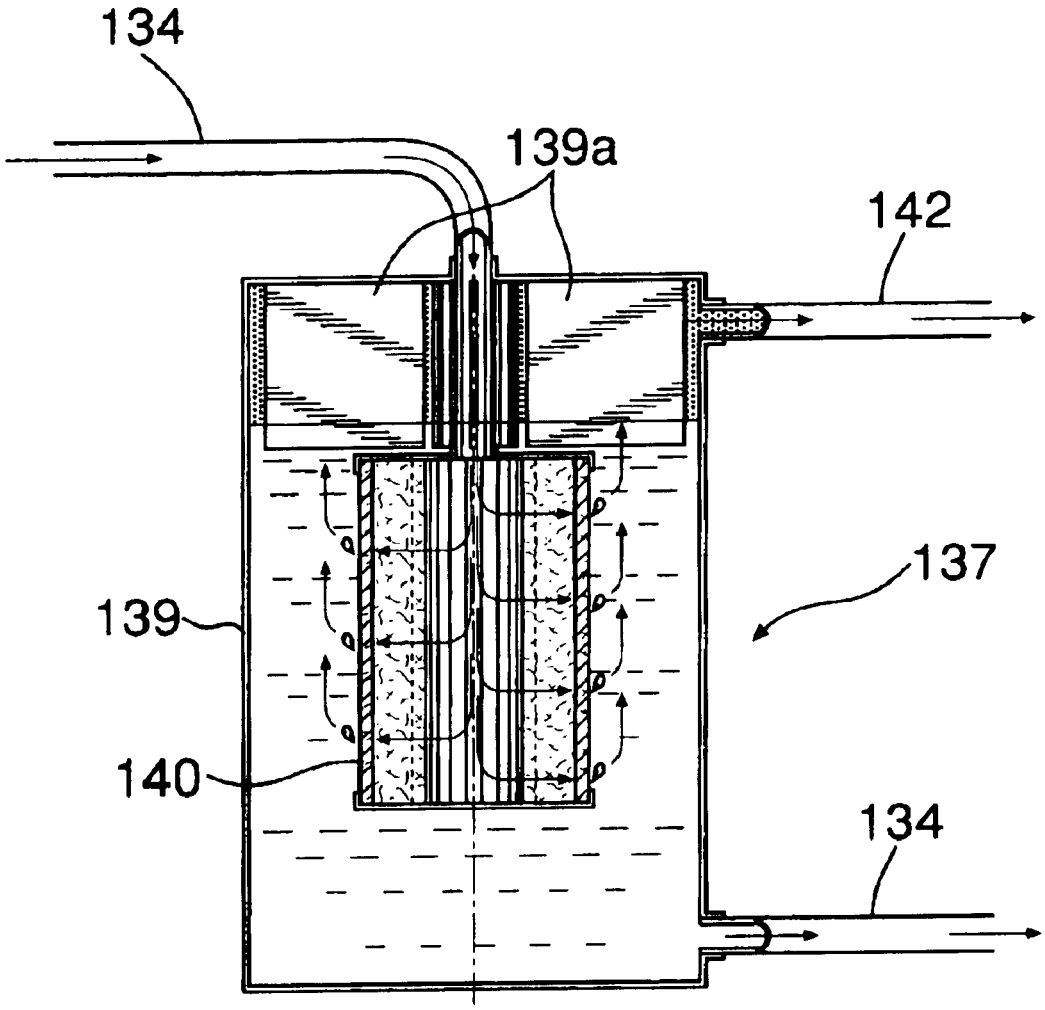

As shown in FIG. 25, the oil separating means 137 is for separating the oil contained in the water. The structure thereof is of a coalescer type, which is substantially the same as that of the downstream side water separating device 122 of the water separating means 118; a hydrophobic ultrafine nylon fiber cylindrical filter element 140 is disposed within a casing 139, and a water-oil mixture in which a small amount of the oil is mixed with the water is supplied to the interior of the filter element 140. In the oil separating means 137, when the water-oil mixture passes through the filter element 140 from the inside to the outside, the small amount of oil contained in the water is captured by the ultrafine nylon fiber and gradually increases its size, and when it turns into oil droplets having a diameter of on the order of 2 to 3 mm, the oil droplets alone float upward due to the difference in specific gravity between the oil and water, which is lighter than oil, thus being separated from the water, which goes downward. In order to prevent the oil that has been collected at the top of the casing 139 of the oil separating means 137 from mixing again with the water due to vibration, etc. accompanying travel of an automobile equipped with the Rankine cycle system, a large number of partitions 139*a* are provided on the top of the casing 139 so as to suppress free flow of the oil. Instead of these partitions 139*a*, it is also possible to arrange a sponge, etc., and the same effects can be obtained.

In this way, since liquid-phase water from which gaseous steam has been removed by the gas/liquid separator 131 is supplied to the oil separating means 137, in comparison with a case in which oil is separated in a state in which steam and water are mixed, the oil separation performance of the oil separating means 137 can be enhanced. Moreover, since the water that has passed through the gas/liquid separator 131 is cooled to 80° C. or lower, which is the heat resistant temperature of the filter element 140 of the oil separating means 137, the oil separation performance and the durability of the oil separating means 137 can be ensured. Furthermore, since the oil separating means 137 is of the coalescer type, which carries out separation by utilizing the difference in specific gravity between water and oil, pressure loss can be suppressed compared with a case in which other membrane type filters are used, and the load on the oil pump 135*b* can be alleviated. The oil that has been separated from the water by the oil separating means 137 is returned to the oil passage 91 of the expander 113 via an oil return passage 142 in which a one-way valve 141 is disposed.

The water discharged from the oil separating means 137 into the bypass 134 contains small-sized oil droplets (no greater than 1 $\mu$m) that could not be separated by the oil separating means 137, and these oil droplets are adsorbed by a filter 138 employing active carbon as the filtering material and removed. The water that has passed through the filter 138 and the water that has returned from the expander 113 via the water return passage 120 are supplied to the water purifying means 132. The water purifying means 132 includes a microfiltration (MF) membrane, an ultrafiltration (UF) membrane, a reverse osmosis filtration (RO) membrane, etc., and microscopic sludge that could not be separated by the prefilter 136 can be removed from the water. Furthermore, the water purifying means 132 carries out a water purification treatment employing ion exchange, an alkalinization treatment, a dissolved oxygen removal treatment, etc., thereby preventing contamination and corrosion of each section of the Rankine cycle system. The water that has passed through the water purifying means 132 is supplied to the feed pump 115 via the tank 133.

As hereinbefore described, since the water separating means 118 for separating the working medium mixed with the oil for lubricating the expander 113 is provided at a position where the working medium is liquid-phase state water, the water can be separated from the oil by making the water separating means 118 function effectively. Similarly, since the oil separating means 137 for separating the oil from the working medium of the Rankine cycle system is provided at a position where the working medium is liquid-phase state water, the oil can be separated from the water by making the oil separating means 137 function effectively.

Furthermore, since the water that has been separated from the oil in the water separating means 118 and the oil separating means 137 is returned to the working medium circulation circuit 110, it is unnecessary to replenish the working medium circulation circuit 110 with water, and since the oil that has been separated from water is returned to the expander 113, it is unnecessary to replenish the expander 113 with oil.

Although an embodiment of the present invention is explained above, the present invention can be modified in a variety of ways without departing from the spirit and scope thereof.

For example, in the embodiment, the internal combustion engine 111 is illustrated as the heat engine, but the present invention can also be applied to a Rankine cycle system employing a heat engine other than the internal combustion engine 111.

Furthermore, in the embodiment, the water separating means 118 comprises the upstream side water separating device 121 and the downstream side water separating device 122, but three or more water separating devices may be provided.

INDUSTRIAL APPLICABILITY

As hereinbefore described, the present invention can be appropriately applied to a Rankine cycle system utilizing waste heat of an internal combustion engine of an automobile, but it can also be applied to a Rankine cycle system utilizing waste heat of an internal combustion engine other than one of an automobile, or a heat engine other than an internal combustion engine.

What is claimed is:

1. A Rankine cycle system comprising a working medium circulation circuit (110) through which a working medium is circulated and that includes an evaporator (112) that makes a working medium of a high-temperature, high-pressure gas-phase by heating the working medium in a liquid-phase by means of waste heat of an internal combustion engine (111), an expander (113) in the circuit (110) that converts the heat and pressure of the working medium of a gas-phase supplied from the evaporator (112) into mechanical energy, a condenser (114) in the circuit (110) that cools the gas-phase working medium whose temperature and pressure have decreased in the expander (113) to turn the working medium back into the liquid-phase working medium, and a feed pump (115) in the circuit (110) that supplies the liquid-phase working medium discharged from the condenser (114) to the evaporator (112), a lubricating medium circulating passage (91) through which a lubricating medium that is different from the working medium is circulated, wherein the expander (113) has a sliding section thereof lubricated by the lubricating medium, the Rankine cycle system further comprising:

working medium separating means (118) for separating from the lubricating medium the working medium that has become mixed with the lubricating medium in the expander (113), and the working medium separating means (118) is provided in the lubricating medium circulating passage (91) at a position where the working medium is in a liquid-phase state, and lubricating medium separating means (137) for separating from the working medium the lubricating medium that has become mixed with the working medium in the expander (113), wherein the lubricating the medium separating means (137) is provided at a position on the downstream side of the expander (113) where the working medium is in a liquid-phase state.

2. The Rankine cycle system according to claim 1, wherein the working medium separating means (118) exhibits a function of separating the working medium in a predetermined temperature range, and the working medium separating means (118) is provided at a position where the lubricating medium is in the predetermined temperature range.

3. The Rankine cycle system according to claim 1, wherein the working medium separating means (118) is formed by connecting at least two working medium separating devices (121, 122) in line.

4. The Rankine cycle system according to claim 1, wherein the lubricating medium separating means (137) exhibits a function of separating the lubricating medium in a predetermined temperature range, and the lubricating medium separating means (137) is provided at a position where the liquid-phase working medium is in the predetermined temperature range.

5. The Rankine cycle system according to claim 1, wherein it further comprises a gas/liquid separator (131) for separating a liquid phase portion contained in the working medium discharged from the expander (113) into the working medium circulation circuit (110), the liquid-phase working medium separated by the gas/liquid separator (131) being supplied to the lubricating medium separating means (137).

6. The Rankine cycle system according to claim 1, wherein it further comprises working medium purifying means (132) for removing cations or dissolved gas contained in the working medium that has been discharged from the expander (113) into the working medium circulation circuit (110) and that has been turned back into the liquid phase state.

7. The Rankine cycle system according to claim 1, wherein the lubricating medium from which the working medium has been separated by the working medium separating means (118) is returned to the expander (113).

8. The Rankine cycle system according to claim 1, wherein the working medium separated from the lubricating medium by the working medium separating means (118) is returned to the working medium circulation circuit (110).

9. The Rankine cycle system according to claim 1, wherein the working medium separating means (118) makes droplets of the working medium contained in the lubricating medium become coarse, and the working medium is separated by virtue of a difference in specific gravity between the lubricating medium and the working medium that has been made into coarse droplets.

10. The Rankine cycle system according to claim 1, wherein the working medium separating means (118) is of a coalescer type.

11. The Rankine cycle system according to claim 10, wherein the working medium separating means (118) comprises a filter element (124, 126) formed from hydrophobic fiber.

12. A Rankine cycle system comprising a working medium circulation circuit (110) through which a working medium is circulated and that includes an evaporator (112) that makes the working medium a high-temperature, high-pressure gas-phase working medium by heating the working medium in a liquid-phase by means of waste heat of an internal combustion engine (111) mounted on a vehicle, an expander (113) in the circuit (110) that converts the heat and pressure of the working medium of a gas-phase supplied from the evaporator (112) into mechanical energy, a condenser (114) in the circuit (110) that cools the gas-phase working medium whose temperature and pressure have decreased in the expander (113) in the circuit (110) to turn the working medium back into the liquid-phase working medium, and a feed pump (115) that supplies the liquid-phase working medium discharged from the condenser (114) to the evaporator (112), a lubricating medium circulating passage (91) through which a lubricating medium that is different from the working medium is circulated, wherein the expander (113) has a sliding section thereof lubricated by a lubricating medium that is different from the working medium, the Rankine cycle system further comprising:

working medium separating means (118) provided in the lubricating medium passage (91) at a position where the working medium is in a liquid state for separating from the lubricating medium the working medium that has become mixed with the lubricating medium, and the lubricating medium is a hydrophobic oil containing no extreme pressure additive having surface activity for preventing emulsification of a mixture of the working and the lubricating mediums, and lubricating medium separating means (137) for separating from the working medium the lubricating medium that has become mixed with the working medium in the expander (113), wherein the lubricating medium separating means (137) is provided at a position on the downstream side of the expander (113) where the working medium is in a liquid-phase state.

13. The Rankine cycle system according to claim 1, wherein the working medium separating means (118) is provided with a coalescer upstream side water separating device (121) and a coalescer downstream side water separating device (122) in line.

14. The Rankine cycle system according to claim 13, wherein the upstream side water separating device (121) is for separating water from an oil-water mixture in which the oil supplied from the expander (113) is mixed with a small amount of water, the upstream side water separating device (121) including a hydrophobic ultrafine nylon fiber cylindrical filter element (124), and the oil-water mixture being supplied into an interior of the filter element (124).

15. The Rankine cycle system according to claim 13, wherein the downstream side water separating device (122) is for separating oil from a water-oil mixture in which the water supplied from the upstream side water separating device (121) is mixed with a small amount of oil, the downstream side water separating device (122) including a hydrophobic ultrafine nylon fiber cylindrical filter element (126), and the water-oil mixture is supplied into an interior of the filter element 126.

16. The Rankine cycle system according to claim 13, further comprising a prefilter (117) the removing dust from the oil-water mixture downstream of a radiator (116), the prefilter preventing clogging of filter elements (124) and (126) of the upstream side water separating device (121) and the downstream side water separating device (122).

17. The Rankine cycle system according to claim 1, wherein an oil pump (135*b*) for feeding water-containing oil, a prefilter (136), the lubricating medium separating means (137), and a filter (138) are disposed in line in a bypass (134) branching from a gas/liquid separator (131) and bypassing the condenser (114).

18. The Rankine cycle system according to claim 1, wherein the working medium separating means (118) and the lubricating medium separating means (137) are of a coalescer type, and the working medium separating means (118) makes droplets of the working medium contained in the lubricating medium become coarse and the lubricating medium separating means (137) makes droplets of the lubricating medium contained in the working medium become coarse, so that the working medium at the working medium separating means (118) and the lubricating medium at the lubricating medium separating means (137) are each separated by virtue of a difference in specific gravity between the lubricating medium and the working medium that has been made into the coarse droplets at respective separating means (118, 137).

19. The Rankine cycle system according to claim 1, wherein the internal combustion engine (111) is mounted on a vehicle.

20. The Rankine cycle system according to claim 1, wherein the working medium separating means (118) exhibits a function of separating the working medium in a predetermined temperature range, and the working medium separating means (118) is provided at a position where the lubricating medium is in the predetermined temperature range, whereas the lubricating medium separating means (137) exhibits a function of separating the lubricating medium in a predetermined temperature range, and the lubricating medium separating means (137) is provided at a position where the liquid-phase working medium is in the predetermined temperature range.

* * * * *